US010480768B2

(12) United States Patent
Parameshwara et al.

(10) Patent No.: US 10,480,768 B2
(45) Date of Patent: Nov. 19, 2019

(54) PLASTIC HEAT SINK FOR LUMINAIRES

(71) Applicant: SABIC Global Technologies B.V., Bergen op Zoom (NL)

(72) Inventors: Arunachala Parameshwara, Bangalore (IN); Venkatesha Narayanaswamy, Bangalore (IN); Remesh Kuzhikkali, Bangalore (IN); Ramanand Singh, Bangalore (IN)

(73) Assignee: SABIC Global Technologies B.V., Bergen Op Zoom (NL)

( * ) Notice: Subject to any disclaimer, the term of this patent is extended or adjusted under 35 U.S.C. 154(b) by 1 day.

(21) Appl. No.: 15/559,517

(22) PCT Filed: Mar. 17, 2016

(86) PCT No.: PCT/IB2016/051518
§ 371 (c)(1),
(2) Date: Sep. 19, 2017

(87) PCT Pub. No.: WO2016/151441
PCT Pub. Date: Sep. 29, 2016

(65) Prior Publication Data

US 2018/0119941 A1 May 3, 2018

(30) Foreign Application Priority Data

Mar. 20, 2015 (IN) ..... 762/DEL/2015

(51) Int. Cl.
*F21V 29/74* (2015.01)
*F21V 3/06* (2018.01)
(Continued)

(52) U.S. Cl.
CPC ..... *F21V 29/74* (2015.01); *F21K 9/90* (2013.01); *F21V 3/062* (2018.02); *F21V 5/048* (2013.01);
(Continued)

(58) Field of Classification Search
CPC ..... F21V 29/74; F21V 29/503; F21V 29/70; F21V 29/80; F21V 29/83; F21V 29/87;
(Continued)

(56) References Cited

U.S. PATENT DOCUMENTS 8,362,677 B1 1/2013 Morejon et al.
8,672,516 B2 3/2014 Chowdhury et al.
(Continued)

FOREIGN PATENT DOCUMENTS

CN 101048056 A 10/2007
CN 201265843 Y 7/2009
(Continued)

OTHER PUBLICATIONS

International Patent Application No. PCT/IB2016/051518; Int'l Preliminary Report on Patentability; dated Sep. 26, 2017; 11 pages.

*Primary Examiner* — Mary Ellen Bowman
(74) *Attorney, Agent, or Firm* — Baker Hostetler

(57) ABSTRACT

Luminaires are disclosed that are configured to emit LED illumination. Certain components of the luminaire can be assembled without the use of fasteners. Further, the luminaires can include a plastic heat sink that can be molded with other components of the luminaire.

19 Claims, 10 Drawing Sheets

(51) Int. Cl.

| | |
|---|---|
| ***F21V 5/04*** | (2006.01) |
| ***F21V 23/00*** | (2015.01) |
| ***F21V 29/70*** | (2015.01) |
| ***F21V 29/83*** | (2015.01) |
| ***F21V 29/87*** | (2015.01) |
| ***F21V 29/503*** | (2015.01) |
| ***F21K 9/90*** | (2016.01) |
| ***F21V 29/80*** | (2015.01) |
| ***F21Y 105/10*** | (2016.01) |
| ***F21Y 115/10*** | (2016.01) |

(52) U.S. Cl.
CPC ..... *F21V 23/006* (2013.01); *F21V 29/503* (2015.01); *F21V 29/70* (2015.01); *F21V 29/80* (2015.01); *F21V 29/83* (2015.01); *F21V 29/87* (2015.01); *F21Y 2105/10* (2016.08); *F21Y 2115/10* (2016.08)

(58) Field of Classification Search
CPC ..... F21V 3/062; F21V 5/048; F21V 23/006; F21K 9/90; F21Y 2105/10; F21Y 2115/10
See application file for complete search history.

(56) References Cited

U.S. PATENT DOCUMENTS

| | | | | |
|---|---|---|---|---|
| 2005/0275131 | A1 | 12/2005 | Hoium et al. | |
| 2006/0274529 | A1 | 12/2006 | Cao | |
| 2008/0130289 | A1 | 6/2008 | Takemoto et al. | |
| 2008/0310167 | A1 | 12/2008 | Zaderej et al. | |
| 2009/0296412 | A1 | 12/2009 | Ogawa et al. | |
| 2010/0014289 | A1 | 1/2010 | Thomas et al. | |
| 2010/0172144 | A1 | 7/2010 | Liu | |
| 2010/0290229 | A1 | 11/2010 | Meyer, Sr. et al. | |
| 2011/0110107 | A1 | 5/2011 | Kawato | |
| 2012/0002419 | A1 | 1/2012 | Zaderej et al. | |
| 2012/0188762 | A1* | 7/2012 | Joung | F21V 15/01 362/235 |
| 2012/0287601 | A1 | 11/2012 | Pickard et al. | |
| 2013/0021777 | A1 | 1/2013 | Pickard et al. | |
| 2013/0051002 | A1 | 2/2013 | Draper et al. | |
| 2013/0057153 | A1 | 3/2013 | Kim et al. | |
| 2013/0285529 | A1* | 10/2013 | Petroski | F21V 29/70 313/46 |
| 2014/0016314 | A1 | 1/2014 | Woodgate et al. | |
| 2014/0036504 | A1 | 2/2014 | Kim et al. | |
| 2014/0043815 | A1 | 2/2014 | Chuang | |
| 2014/0240989 | A1 | 8/2014 | Hardikar | |
| 2014/0313750 | A1 | 10/2014 | Cheng | |
| 2014/0355241 | A1 | 12/2014 | Takenaka et al. | |
| 2015/0211723 | A1 | 7/2015 | Athalye | |
| 2016/0091193 | A1 | 3/2016 | Cai et al. | |
| 2016/0165698 | A1 | 6/2016 | Grajcar | |
| 2016/0225691 | A1 | 8/2016 | Sanda et al. | |
| 2017/0273281 | A1 | 9/2017 | Grajcar et al. | |

FOREIGN PATENT DOCUMENTS

| | | | |
|---|---|---|---|
| CN | 101526198 | A | 9/2009 |
| CN | 102084178 | A | 6/2011 |
| CN | 102606904 | A | 7/2012 |
| CN | 103375786 | A | 10/2013 |
| CN | 203534296 | U | 4/2014 |
| CN | 103814251 | A | 5/2014 |
| CN | 203594979 | U | 5/2014 |
| DE | 102006001947 | A1 | 3/2007 |
| EP | 1762432 | A2 | 3/2007 |
| JP | S48-002386 | U | 6/1971 |
| JP | S54-142987 | U | 3/1978 |
| JP | 2009-081220 | A | 4/2009 |
| JP | 2009-302302 | A | 12/2009 |
| JP | 2010-009770 | A | 1/2010 |
| JP | 2011-070860 | A | 4/2011 |
| JP | 2012-049407 | A | 3/2012 |
| JP | 2012-119230 | A | 6/2012 |
| JP | 2013-243361 | A | 12/2013 |
| JP | 2014-093427 | A | 5/2014 |
| JP | 2014-112495 | A | 6/2014 |
| JP | 2014-123580 | A | 7/2014 |
| JP | 2014-207153 | A | 10/2014 |
| KR | 2010-0089392 | A | 8/2010 |
| KR | 2010-0114398 | A | 10/2010 |
| KR | 2013-0006273 | U | 10/2013 |
| WO | WO 2011/079643 | A1 | 7/2011 |
| WO | WO 2012/100022 | A2 | 7/2012 |
| WO | WO 2013/046292 | A1 | 4/2013 |
| WO | 2013156511 | A1 | 10/2013 |

* cited by examiner

PLASTIC HEAT SINK FOR LUMINAIRES

CROSS-REFERENCE TO RELATED APPLICATIONS

This application is the National Stage of International Application No. PCT/IB2016/051518, filed Mar. 17, 2016, which claims the benefit of Indian Application No. 762/DEL/2015, filed Mar. 20, 2015, the disclosures of which are incorporated herein by reference in their entireties.

BACKGROUND

Luminaires are available in many shapes, sizes, and configurations. Modern luminaires can include light emitting diodes (LEDs) as opposed to traditional incandescent light bulbs for their high energy efficiency and longevity. Conventional LED-based luminaires employ metallic heat sinks that direct heat away from the LEDs during operation. In luminaires having plastic metallic heat sinks, various other components of the luminaire are attached to the heat sinks, for instance via external fasteners, which can cause fabrication of the luminaires to be time consuming and inefficient.

SUMMARY

In accordance with one aspect of the present disclosure, a luminaire can include a plastic heat sink, a first driver cover that can at least substantially close a first end of the heat sink body, and a driver that is configured to receive input electrical power from an electrical power source, and output electrical power. The luminaire can further include a second driver cover attached to the heat sink body, such that the driver is contained between the first driver cover and the second driver cover. The luminaire can further include an LED panel that can further include at least one LED carried by the substrate, wherein the at least one LED is in electrical communication with the driver so as to receive the output electrical power and, in response, produce illumination. The luminaire can further include a lens assembly supported by the heat sink. One of the first driver cover and the lens assembly can be monolithic with the heat sink body at a respective one of the first and second ends, such that the LED panel is configured for insertion into the heat sink body at the other of the first and second ends.

In accordance with another aspect of the present disclosure, a luminaire can include a heat sink that defines a first end and an open second end opposite the first end along a central axis. The luminaire can further include a driver that is configured to receive input electrical power from an electrical power source, and output electrical power. The luminaire can further include an LED panel that, in turn, includes a substrate supported by the heat sink body, and at least one LED carried by the substrate, wherein the at least one LED is in electrical communication with the driver so as to receive the output electrical power and, in response, produce illumination. The luminaire can further include a lens assembly that closes the open second end of the heat sink. The lens assembly can include a bezel that is supported by the second end of the heat sink, and a lens that is supported at its periphery by the bezel and monolithic with the bezel. An entirety of the lens assembly can be made of a plastic configured to emit at least a portion of the illumination produced by the at least one LED.

In accordance with another aspect of the present disclosure, a luminaire can include a heat sink body that defines a first end, a second end opposite the first end along a central axis. The luminaire can further include a first driver cover supported at the first end of the heat sink body, wherein the first driver cover substantially closes the first end. The luminaire can further include a driver that is configured to receive input electrical power from an electrical power source, and output electrical power. The luminaire can further include a second driver cover attached to the heat sink body, such that the driver is contained between the first driver cover and the second driver cover. The luminaire can further include an LED panel that, in turn, includes a substrate supported by the heat sink body at a location such that the first driver cover is disposed between the LED panel and the driver, and at least one LED carried by the substrate, wherein the at least one LED is in electrical communication with the driver so as to receive the output electrical power and, in response, produce illumination. The luminaire can further include a lens assembly supported by the heat sink at the second end, such that at least a portion of the illumination passes through the lens assembly and out the luminaire. Each of the second driver cover and the lens assembly can be configured to be fit to the heat sink body so as to attach 1) the second driver cover to the first end of the heat sink body, and 2) the lens assembly to the second end of the heat sink body.

In accordance with another aspect of the present disclosure, a heat sink for a luminaire can include a plastic heat sink body that includes a side wall having an open first end and an open second end opposite the open first end. The heat sink can further include a driver cover monolithic with the heat sink body so as to substantially close the first end, such that the side wall extends beyond the driver cover in a direction from the second end to the first end so as to define a driver cavity sized to receive an LED driver. The driver cover can define at least one aperture sized to receive an electrical conduit that is in electrical communication with the driver and is configured to place at least one LED in electrical communication with the LED driver.

At least some of the above features can allow the luminaire to be assembled using assembly steps that can be less time consuming compared to conventional luminaires. Furthermore, the luminaire can be assembled using fewer assembly steps compared to conventional luminaires. In this regard, other aspects of the present disclosure include methods for fabricating and assembling luminaires.

In accordance with another aspect of the present disclosure, a lens assembly is configured to close an end heat sink of a luminaire. The lens assembly can include a plastic bezel configured to attach to an open end of the luminaire, wherein the plastic bezel encloses an interior. The lens can further include a plastic diffuser monolithic with the plastic bezel so as to extend along an entirety of the interior. When the lens assembly closes the end of the heat sink, the plastic diffuser can be configured to allow illumination from the luminaire to pass through.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

The foregoing summary, as well as the following detailed description, is better understood when read in conjunction with the appended drawings. There is shown in the drawings example embodiments of various embodiments, however the present invention is not limited to the specific methods and instrumentalities disclosed. In the drawings.

DETAILED DESCRIPTION

Figure 1A:
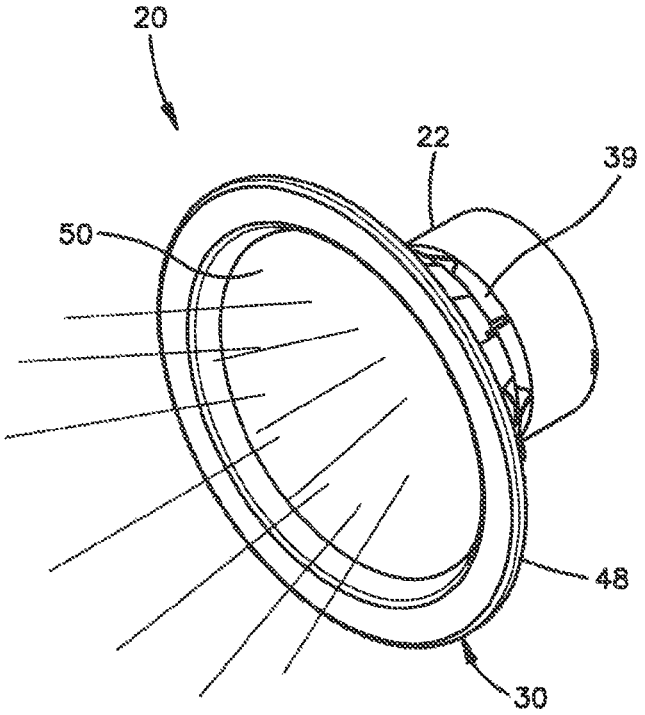
FIG. 1A is a perspective view of a luminaire of one embodiment.
Figure 1B:
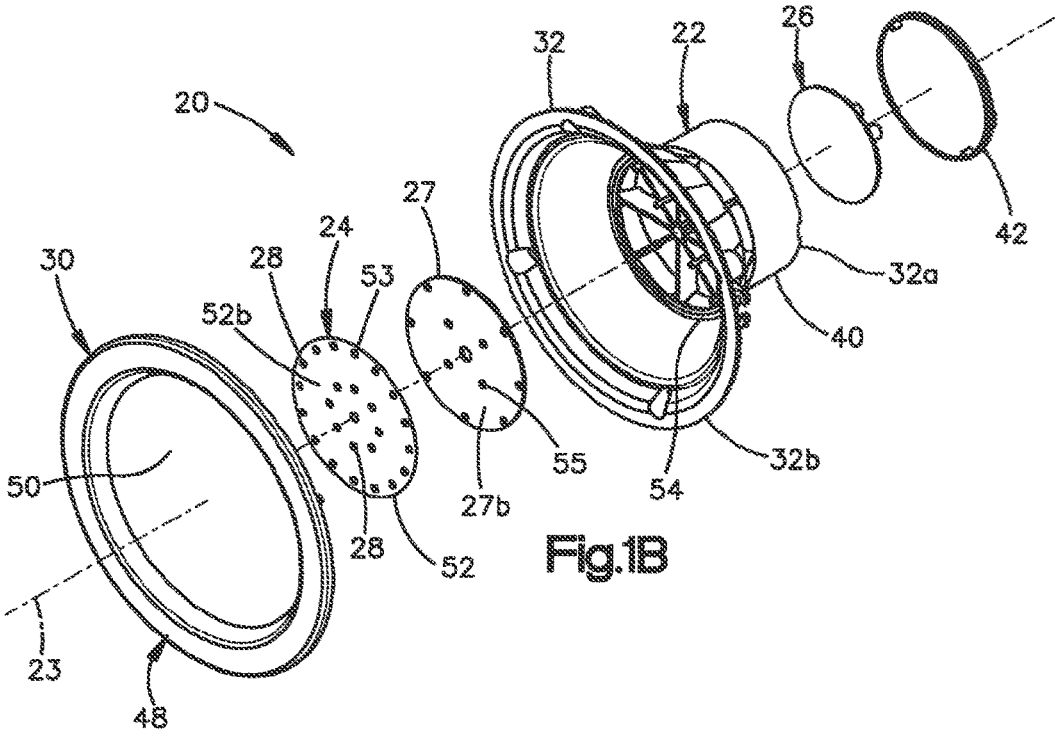
FIG. 1B is an exploded perspective view of the luminaire shown in FIG. 1A.
Figure 1C:
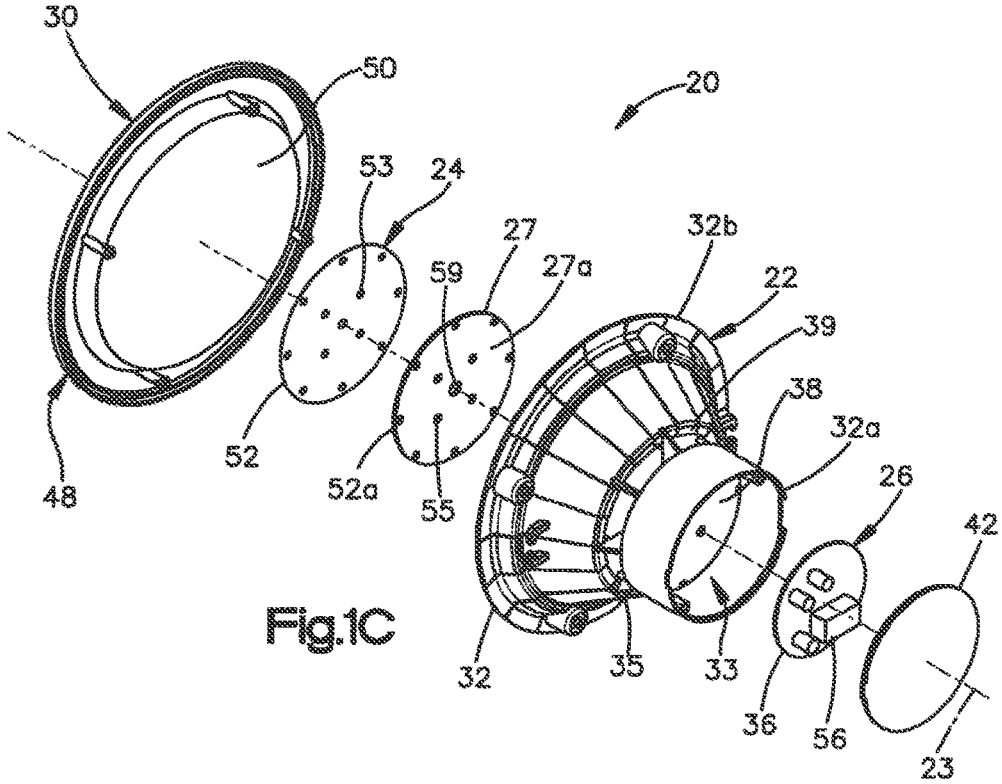
FIG. 1C is another exploded perspective view of the luminaire shown in FIG. 1A.
Figure 1D:
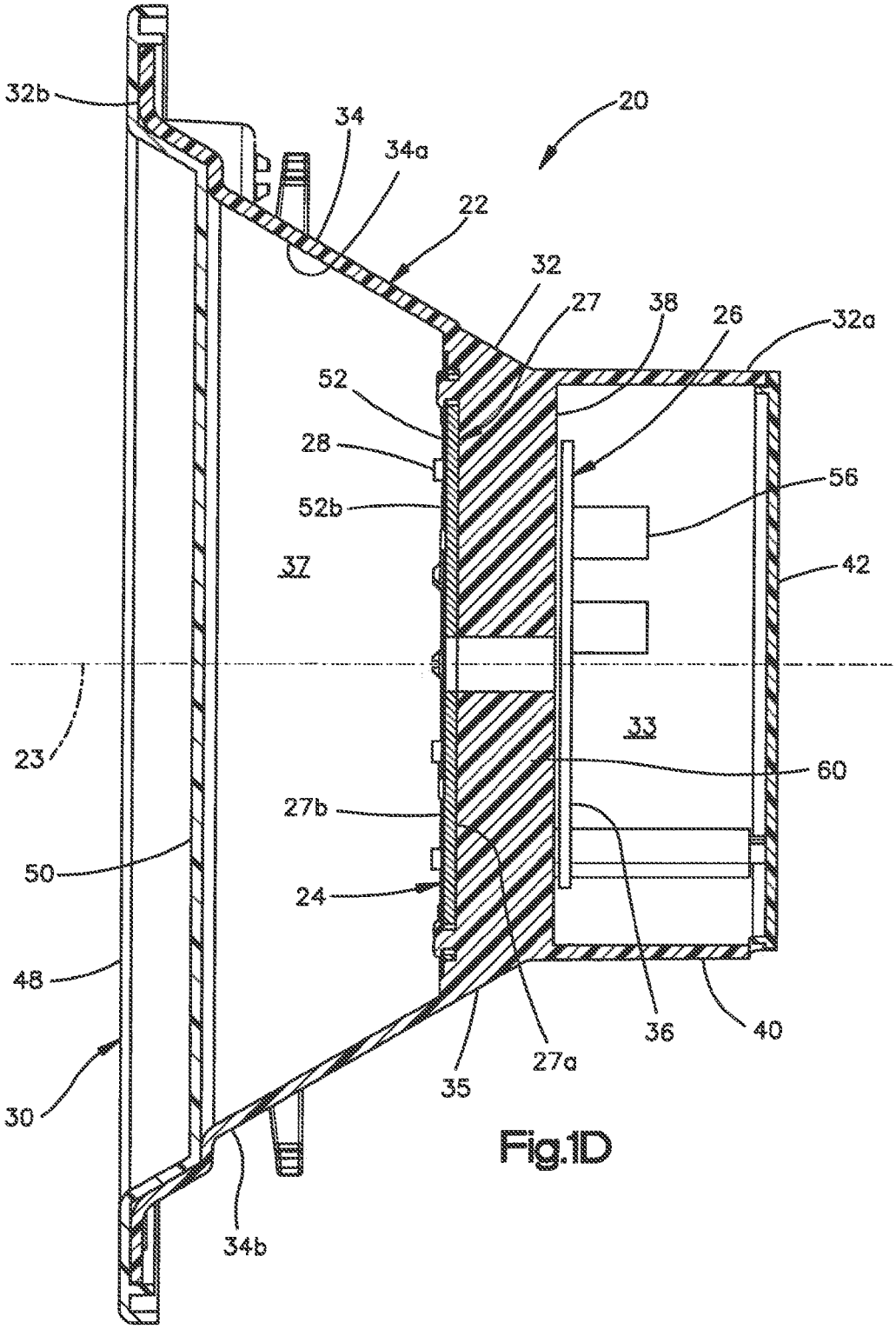
FIG. 1D is a sectional side elevation view of the luminaire shown in FIG. 1A.

Referring to FIGS. 1A-1D, a luminaire 20 is configured to emit LED illumination. As will be appreciated from the description below, the luminaire 20 can be assembled using assembly steps that can be less time consuming compared to conventional luminaires. For instance, the luminaire 20 can be assembled using fewer fasteners than conventional luminaires, or potentially no fasteners. Furthermore, the luminaire 20 can be assembled using fewer assembly steps compared to conventional luminaires. For instance, components that are individually assembled to each other in conventional luminaires can be configured as one monolithic component of the luminaire 20 of the present disclosure.

The luminaire 20 includes a heat sink 22, and a light source in thermal communication with the heat sink 22. The light source can be configured as an LED panel 24 that is supported by the heat sink 22, and a driver 26 that is supported by the heat sink 22. The luminaire 20 can further include a support plate 27 that is supported by the heat sink 22 and, in turn, supports the LED panel 24. Alternatively, the LED panel 24 can be directly supported by the heat sink 22. The driver 26 is configured to receive input electrical power from an electrical power source, and output electrical power. The electrical power source can be an external power source that is external to the luminaire 20, or can be an on-board electrical power source such as an electrochemical cell. The driver 26 is in electrical communication with the LED panel 24, such that at least one LED (light emitting diode) 28 of the LED panel 24 is configured to receive the output electrical power and, in response, produce illumination. The heat sink 22 is in thermal communication with the at least one LED 28 so as to dissipate heat from the at least one LED 28. The luminaire 20 can further include a lens assembly 30 that is supported by the heat sink, such that at least a portion of the illumination from the at least one LED can pass through the lens assembly and out the luminaire 20.

The heat sink 22 can include a heat sink body 32 that defines a first end 32*a* and a second end 32*b* of the heat sink 22. The second end 32*b* can be opposite the first end 32*a* along a central axis 23, such that the heat sink body 32, and thus the heat sink, extend along the central axis 23. The first end 32*a* of the heat sink body 32 can be an open end. Similarly, the second end 32*b* of the heat sink body 32 can be an open end. The heat sink body 32 can include at least one side wall 34 that extends from the first end 32*a* to the second end 32*b* along the central axis 23. The at least one side wall 34, and thus the heat sink body 32, can define an interior space 37 that extends between the first end 32*a* and the second end 32*b*. For instance, the at least one side wall 34 can define an inner surface 34*a* that defines and faces the interior space 37, and an outer surface 34*b* opposite the inner surface 34*a*. The at least one side wall 34 can define any number of side walls having any suitable geometry as desired. For instance, the at least one side wall 34 can be substantially cylindrical at the first end 32*a*, and substantially frustroconical at the second end 32*b*. The first end 32*a* can be substantially cylindrical about the central axis 23, and the second end 32*b* can be substantially frustroconical about the central axis 23. In this regard, it should be appreciated that the heat sink body 32 can approximate a cylinder to a greater degree at the first end 32*a* than the second end 32*b*. The heat sink body 32 can define a neck 35 that extends between the first end 32*a* and the second end 32*b*.

The first end 32*a* of the heat sink body 32 can define a first cross sectional dimension at a first cross-section along a direction that is perpendicular to the central axis 23. The second end 32*b* can define a second cross-sectional dimension at a second cross-section along a direction perpendicular to the central axis. The second cross sectional dimension can be greater than the first cross sectional dimension.

Further, the first and second cross-sections can be inner cross-sections or outer cross-sections. The first cross-section can be a round cross-section along a plane that is normal to the central axis 23. For instance, the first cross-section can be substantially circular. Thus, the first cross-sectional dimension can extend along a diameter. Similarly, the second cross-section can be a round cross-section along a plane that is normal to the central axis 23. For instance, the second cross-section can be substantially circular. Thus, the second cross-sectional dimension can extend along a diameter.

The heat sink 22 can further include a first driver cover 38 that is supported by the heat sink body 32. In one example, the first driver cover 38 can be monolithic with the heat sink body 32. For instance, the first driver cover 38 and the heat sink body 32 define a single molded part. Alternatively, the first driver cover can be attached to the heat sink body 32 using any suitable mechanical fastener. For instance, the first driver cover 38 can be snap-fit to the heat sink body 32, press-fit to the heat sink body 32, heat staked to the heat sink body 32, or fastened to the heat sink body 32 using any suitable fastener, such as screws, or the like. The first driver cover 38 can extend along the interior space 37 of the heat sink 22. For instance, the first driver cover 38 can be oriented along a plane that is substantially normal to the central axis 23. In this regard, the first driver cover 38 can substantially close the first end 32*a* of the heat sink body 32. It should be appreciated that the first driver cover 38 can define at least one aperture that is configured to receive an electrical conductor is electrically connected to both the driver 26 and the at least one LED 28, thereby placing the at least one LED 28 in electrical communication with the driver 26.

The first end 32*a* of the heat sink body 32 can define a flange 40 that projects out from the first driver cover 38 a depth sufficient to receive the driver 26. For instance, the at least one side wall 34 can define the flange 40. The flange 40 can be disposed radially outboard of an outer periphery of the first driver cover 38. In one example, the flange 40 can project out with respect to the first driver cover 38 in a direction that is directed from the second end toward the first end along the central axis.

The luminaire 20 can include a second driver cover 42 that is configured to be attached to the heat sink 22. For instance, the second driver cover 42 can attach to the flange 40. The driver 26 can be disposed adjacent the first driver cover 38 such that the first driver cover 38 is disposed between the driver 26 and the LED panel 24. In this regard, the first driver cover 38 can mechanically isolate the driver 26 from the LED panel 24. When the second driver cover 42 is attached to the flange 40, and thus the heat sink body 32, the driver 26 can be contained between the first driver cover 38 and the second driver cover 42. Accordingly, it should be appreciated that the at least one side wall 34 can extend beyond the first driver cover 38 in a direction from the second end to the first end along the central axis 23 so as to define a driver cavity 33 sized to receive the LED driver 26. The driver 26 can include a substrate 36, such as a printed circuit board, and electronics 56 mounted to the substrate 36, such that the electronics 56 are placed in electrical communication with the at least one LED 28. The substrate 36 can be mounted to any one or more of the first driver cover 38, the second driver cover 42, and heat sink body 32, such as the flange 40.

Figure 2:
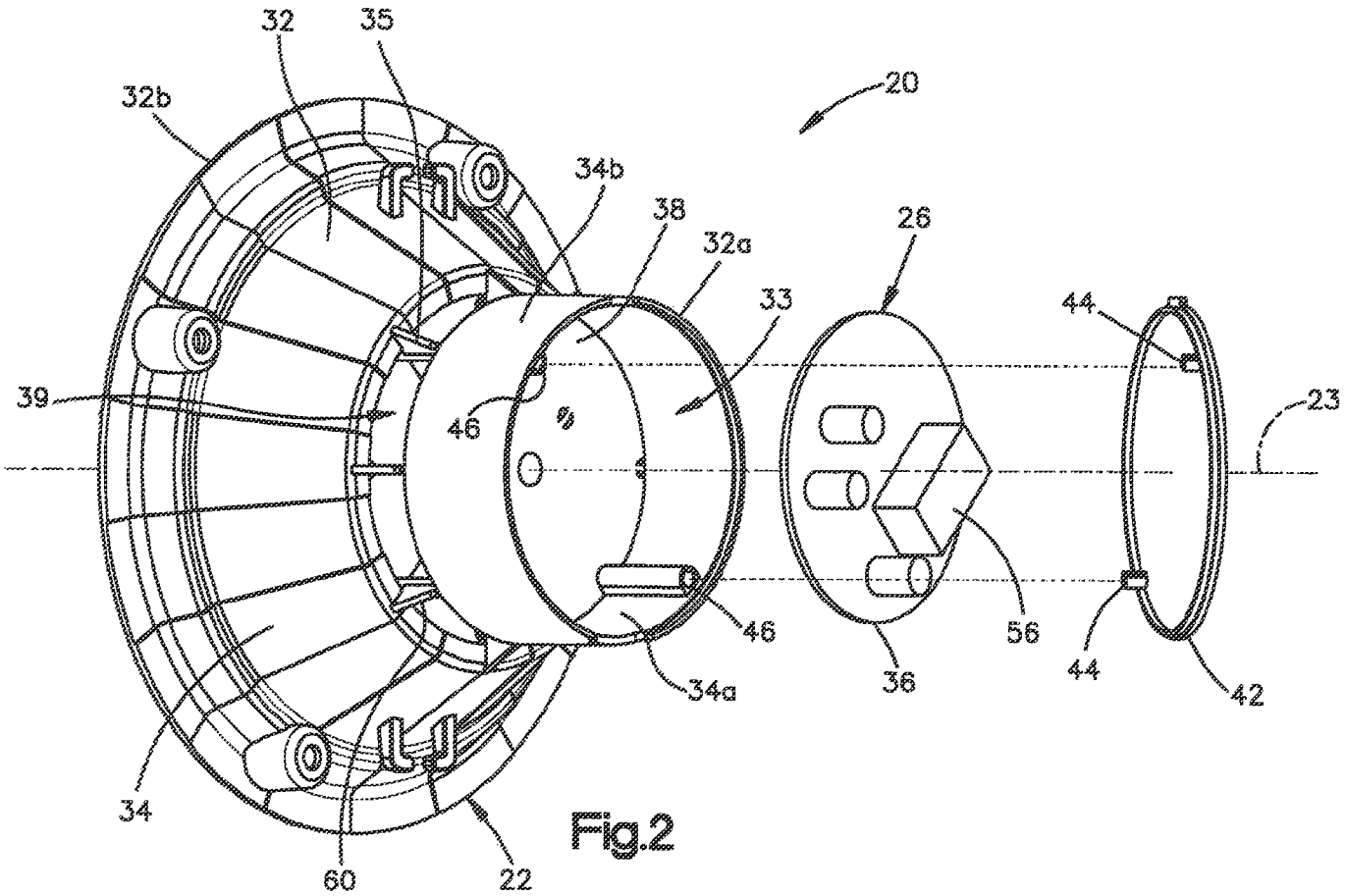
FIG. 2 shows is a partially exploded perspective view of the luminaire shown FIG. 1A, illustrating attachment of a driver cover to a heat sink of the luminaire.

Referring now to FIG. 2, the second driver cover 42 can be attached to the heat sink body 32 in any suitable manner as desired. For instance, the second driver cover 42 can be fit to the heat sink body 32, such as press fit or snap fit to the heat sink body 32. Accordingly, attachment of the second driver cover 42 to the heat sink 22 can occupy less time compared to conventional luminaires that fasten a second driver cover to a heat sink with mechanical fasteners. In one example, the second driver cover 42 can include at least one first attachment member 44 such as a plurality of first attachment members 44. The heat sink body 32 can similarly include a complementary at least one second attachment member 46, such as a plurality of second attachment members 46. For instance, the second attachment member 46 can be carried by the inner surface 34*a*. The first and second attachment members 44 and 46 can be aligned with each other and can ride along each other as the second driver cover 42 is attached to the heat sink body 32.

In one example, the first and second attachment members 44 and 46 can be press-fit together so as to press-fit the second driver cover 42 and the heat sink body 32 together. For instance, the first attachment member 44 can be press-fit in the second attachment member 46. Alternatively, the second attachment member 46 can be press-fit in the first attachment member 44. Alternatively still, the first and second attachment members 44 and 46 can be snap-fit together so as to attach the second driver cover 42 to the heat sink body 32. Accordingly, the first and second attachment members 44 and 46 can elastically deform from a respective first position to a respective second position as they ride along each other. Thus, it can be said that the heat sink body 32 and the second driver cover 42 can elastically deform as the second driver cover 42 is attached to the heat sink body 32. The first and second attachment members 44 and 46 can return to their respective first positions so as to secure the second driver cover 42 to the heat sink body 32. It should be appreciated, of course, that alternatively or additionally, the second driver cover 42 can be heat staked to the heat sink body 32, fastened to the heat sink body 32 using external mechanical fasteners, such as screws, or attached in any suitable alternative manner as desired.

Figure 3A:
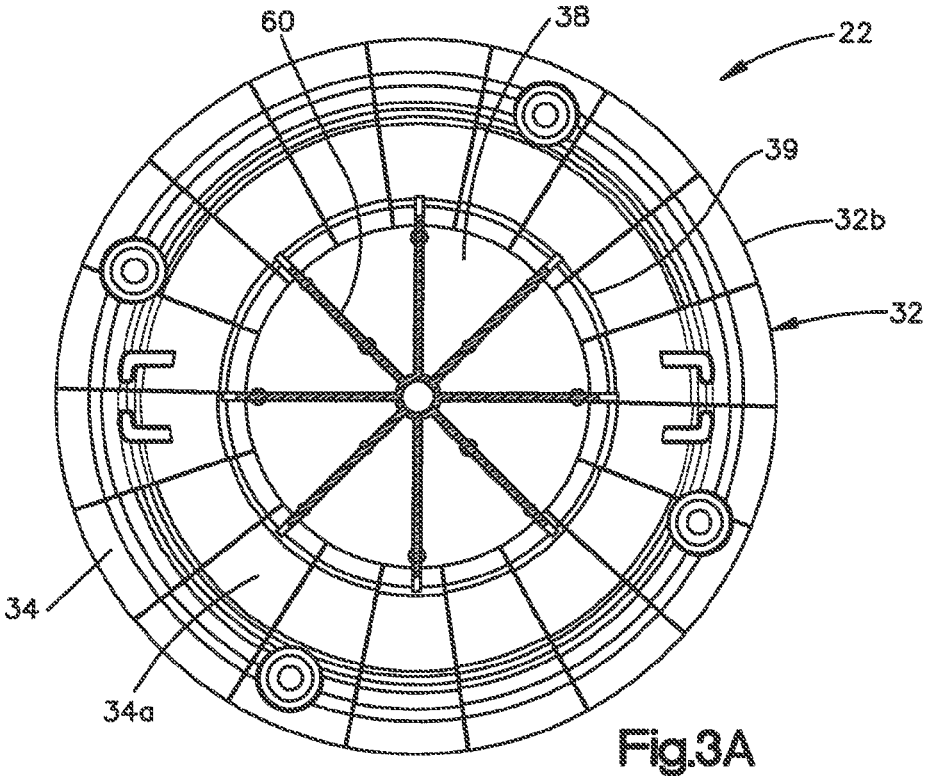
FIG. 3A is a sectional end elevation view of the luminaire shown in FIG. 1A.

Referring also to FIG. 3A, the heat sink body 32 can further define at least one aperture 39 that extends through the at least one side wall 34 from the inner surface 34*a* to the outer surface 34*b*. For instance, the at least one aperture 39 can include a plurality of apertures 39 that extend through the at least one side wall 34 from the inner surface 34*a* to the outer surface 34*b*. The apertures 39 can further extend into the interior space 37, and can be disposed between adjacent ones of a plurality of cross ribs 60 that extend into the interior space 37 from the inner surface 34*a*. The cross ribs 60 can be disposed at the neck 35 of the heat sink body 32. Further, the cross ribs 60 can extend from the first driver cover 38 toward the second end 32*b*. In one example, the cross ribs 60 can be homogeneous with the first driver cover 38, and thus made from the same plastic. Alternatively, the cross ribs 60 and the first driver cover 38 can be made from different plastics. The cross ribs 60 can be circumferentially arranged about the central axis 23 in the interior space 37. The plurality of apertures 39 can be positioned as desired so as to facilitate airflow out of the interior space 37, thereby removing heat from the LED panel 24 so as to substantially assist in maintaining the at least one LED 28 at a desired LED junction temperature as described in more detail below. Thus, the apertures 39 can be referred to as heat egress apertures. In one example, the plurality of apertures 39 can be spaced from each other about the central axis 23. Thus, when the cross-section of the at least one side wall 34 is circular, the plurality of apertures can be circumferentially aligned about the central axis 23. The at least one aperture 39 can be disposed in the neck 35 of the heat sink body 32.

Thus, the at least a portion of the at least one aperture 39 can be disposed between the LED panel 24 and the first driver cover 38 with respect to a direction defined by an orientation of the central axis 23. For instance, an entirety of the at least one aperture 39 is disposed between the LED panel 24 and the first driver cover 38 with respect to the direction defined by the orientation of the central axis 23.

Figure 3B:
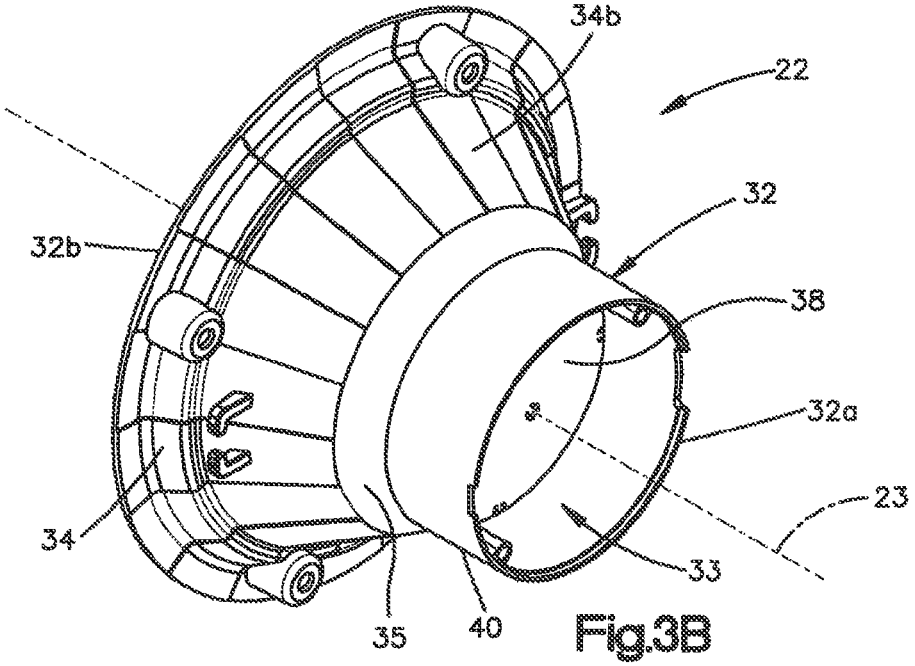
FIG. 3B is another perspective view of the luminaire shown in FIG. 1A.

Alternatively, as illustrated in FIG. 3B, the heat sink body 32 can be devoid of the at least one aperture 39. Thus, the at least one side wall 34 can be substantially solid about the central axis 23 from a first location radially aligned with the first driver cover 38 to a second location radially aligned with the LED panel 24. Thus, the neck 35 can be substantially solid and continuous about the central axis 23. Further, the at least one side wall 34 can be substantially solid and continuous about the central axis 23 from the first location to the second end 32*b* of the heat sink body 32.

Figure 4A:
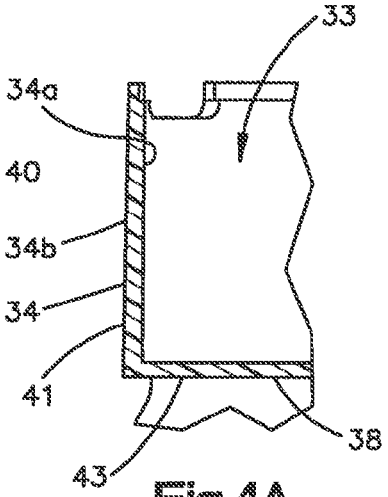
FIG. 4A is a sectional side elevation view of a portion of the luminaire shown in FIG. 1A, illustrating a driver cover monolithic with a heat sink body in one embodiment.
Figure 4B:
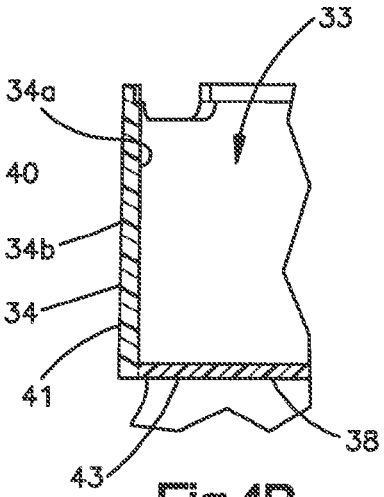
FIG. 4B is a sectional side elevation view of a portion of the luminaire shown in FIG. 1A, illustrating a driver cover monolithic with a heat sink body in another embodiment.

Referring now to FIGS. 4A-4B, and as described above, the luminaire 20 can include at least one first component and at least one second component that are monolithic with each other, that are conventionally separate from each other and attached to each other in typical luminaires. For instance, the at least a first component can be at least partially defined by the heat sink body 32. The heat sink body 32 can be plastic, and can be manufactured using an injection molding process or any suitable alternative manufacturing process as desired. The heat sink body 32 can be injection molded with the at least one second component of the luminaire 20 that is thus monolithic with the heat sink body 32. The at least one second component of the luminaire 20 can be at least partially defined by the first driver cover 38. Thus, the first driver cover 38 can be monolithic with the heat sink body 32. For instance, the heat sink 22 can be made of a first plastic 41. Similarly, the first driver cover 38 can be made of a second plastic 43. Thus, the heat sink body 32 and the first driver cover 38 can be injection molded as a single monolithic part. Thus, in one example illustrated in FIG. 4A, the first and second plastics 41 and 43 can be made from the same plastic material, and can thus be homogeneous with each other. Alternatively, as illustrated in FIG. 4B, the first plastic 41 can be made from a first plastic material, and the second plastic 43 can be made from a second plastic material different from the first plastic material. Thus, the heat sink 22 can be a monolithic part that includes a co-injected heat sink body 32 and the first driver cover 38. For instance, the heat sink body 32 and the first driver cover 38 can be injection molded as a single monolithic two-shot injection molded part, the first shot being defined by the first plastic material, and the second shot being defined by the second plastic material.

In one example, the first plastic material is a thermoplastic. The first plastic material can be thermally conductive, and thus can have a thermal conductivity sufficient to allow the heat sink 22 to remove a sufficient amount of heat from the LED panel 24 to thereby substantially assist in maintaining the at least one LED 28 at or below a desired maximum LED junction temperature. The heat sink 22 can receive heat from the at least one LED 28 by thermal conduction or thermal convection, or a combination of thermal conduction and thermal convection. In one example, the desired maximum LED junction temperature can be 90 degrees Celsius. In one embodiment, the first plastic material can have a thermal conductivity in-plane of a 60 mm (millimeters)×60 mm×3 mm plaque in a range between and including approximately 1 W/m-k (watts per meter-kelvin) and approximately 20 W/m-k, as measured in accordance with Standard ISO 22007-2 (2008). In one example, the in-plane thermal conductivity can be in a range between and including approximately 1.25 W/M-k and approximately 18.0 W/m-k, such as approximately 1.5 W/m-k, approximately 1.9 W/m-k, approximately 3.3 W/m-k, approximately 3.4 W/m-k, or approximately 18 W/m-k as measured in accordance with Standard ISO 22007-2 (2008). The first plastic material can have a thermal conductivity through-plane of the 60 mm×60 mm×3 mm plaque in a range between and including 0.5 and 5 W/m-k, such as approximately 2.0 W/m-k as measured in accordance with Standard ISO 22007-2 (2008). For instance, the through-plane thermal conductivity can be in the range between and including 0.8 W/m-k and 1.5 W/m-k, such as approximately 1.3 W/m-k as measured in accordance with Standard ISO 22007-2 (2008). The first plastic material can have a melt temperature between approximately 320 degrees Celsius and 350 degrees Celsius. Both in-plane and through-plane thermal conductivities identified herein can be measured in accordance with Standard ISO 22007-2 (2008). Approximate thermal conductivity values can account for typical variations in such measurements. The root mean square (RMS) value of the in-plane and through-plane conductivities as described above can be in a range between and including approximately 1.2 W/m-k and approximately 12.8 W/m-K. The first plastic material can be electrically insulative or electrically conductive as desired.

One example of such a first plastic material is Konduit™ plastic material commercially available from SABIC, having a principal place of business in Riyadh, Saudi Arabia. As described above, the second plastic material can be the same as the first plastic material. Alternatively, the second plastic material can be different than the first plastic material. For instance, the second plastic material can be a reflective plastic. Further, the second plastic material can have a thermal conductivity less than the first plastic material. In one example, the second plastic material can be a polycarbonate. For instance, the second plastic material can be a Lexan™ polycarbonate, commercially available from SABIC. The Lexan™ polycarbonate can have a thermal conductivity between and including approximately 0.2 W/m-k and approximately 0.25 W/m-k, and a melt temperature of approximately 300 degrees Celsius. Alternatively, the second plastic material can be a Cycoloy Polycarbonate/Acrylonitrile Butadiene Styrene (PC/ABS), commercially available from SABIC, having an in-plane thermal conductivity of approximately 0.2 W/m-k and a melt temperature of approximately 220 degrees Celsius. It should be appreciated that the second plastic material can have an in-plane thermal conductivity between and including approximately 0.05 W/m-k and approximately 1.25 W/m-k, such as between and including approximately 0.05 W/m-k and approximately 0.50 W/m-k, for instance between approximately 0.2 W/m-k and approximately 0.25 w/m-k. The second plastic material can further have a melt temperature in a range between and including approximately 250 degrees Celsius and approximately 350 degrees Celsius. It should be appreciated, of course, that the first and second plastic materials can define any suitable plastic material as desired.

Referring now to FIGS. 1A-1D and 5A-5B, the lens assembly 30 can include a bezel 48 and a lens 50 that is supported by the bezel 48. The lens 50 can be configured to shape the illumination output from the at least one LED 28. For instance, the lens 50 can be configured as a diffuser. The lens assembly 30 can be supported by the heat sink body 32 so as to close the second end 32*b*. The lens assembly 30 can be monolithic with the heat sink body 32 as described below, or can be attached to the heat sink body 32 using any suitable mechanical fastener. For instance, the lens assembly 30 can be snap-fit to the heat sink body 32, press-fit to the heat sink body 32, heat staked to the heat sink body 32, or fastened to the heat sink body 32 using any suitable fastener, such as screws, or the like. The lens assembly 30 can be oriented along a plane that is substantially normal to the central axis 23.

In one example, the bezel 48 can be supported by the second end 32*b* of the heat sink 22. For instance, the bezel 48 can be attached to the open second end 32*b*. The bezel 48 can define an annulus having an interior space 57. The lens 50 can be supported at its outer periphery by the bezel 48. Thus, the lens 50 can extend along an entirety of the interior space 57 of the bezel 48. Thus, when the lens assembly 30 closes the second end 32*b* of the heat sink body 32, the lens 50 is configured to allow illumination from the luminaire to pass through.

As described above, the luminaire can include at least one first component and at least one second component that is monolithic with the at least one first component. The at least one first component can be at least partially defined by the lens bezel. The at least one second material can be at least partially defined by the lens 50. Thus, the lens 50 can be monolithic with the bezel 48. In one example, the lens 50 and the bezel 48 can define a single molded part. The entire lens 50 can be made from a plastic configured to emit at least a portion of the illumination produced by the at least one LED 28. Otherwise stated, the lens 50 can be at least translucent or transparent.

Figure 5A:
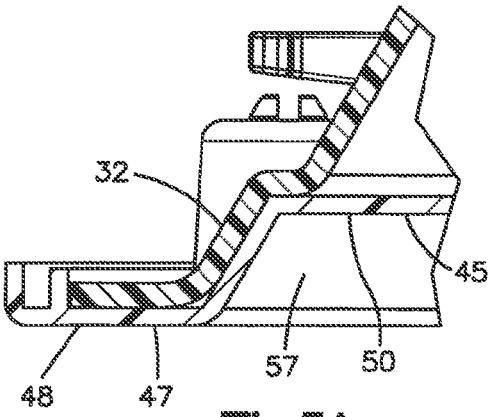
FIG. 5A is a sectional side elevation view of a portion of the luminaire shown in FIG. 1A, illustrating a lens assembly including a bezel and a lens monolithic with the bezel.
Figure 5B:
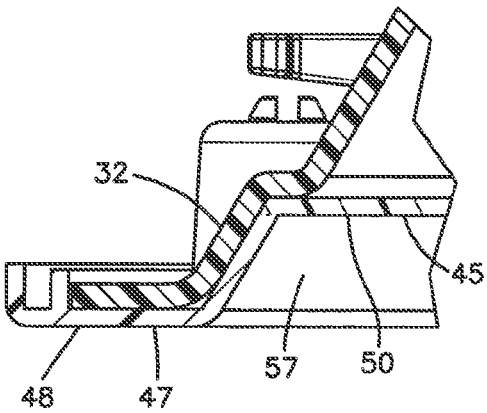
FIG. 5B is a sectional side elevation view of a portion of the luminaire shown in FIG. 1A, illustrating a lens assembly including a bezel and a lens monolithic with the bezel in another embodiment.
Figure 5C:
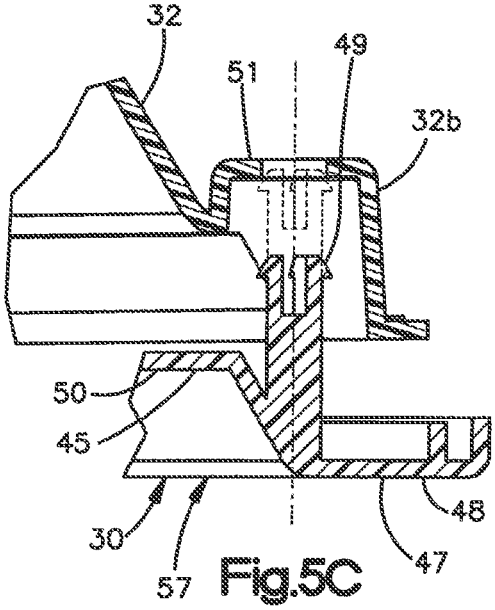
FIG. 5C is an exploded sectional side elevation view of a portion of the luminaire of FIG. 1A, showing the bezel aligned for attachment with the heat sink body.
Figure 5D:
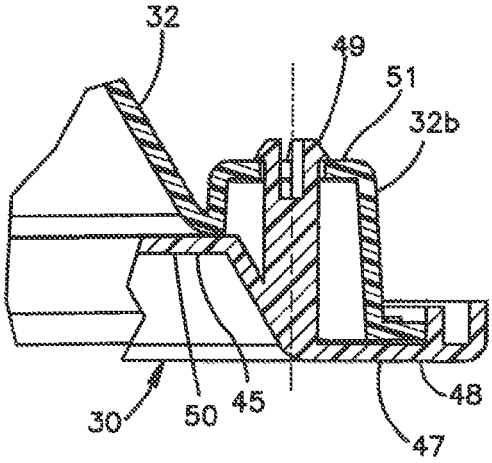
FIG. 5D is an exploded sectional side elevation view of the portion of the luminaire as illustrated in FIG. 5C, showing the bezel attached to the heat sink body.

Referring now also to FIGS. 5C-5D, the bezel 48 can be attached to the heat sink body 32, and thus the heat sink 22, in any suitable manner as desired. It is appreciated that when the lens 50 is monolithic with the bezel 48, attachment of the bezel 48 to the heat sink body 32 further causes the lens 50 to be supported at the second end of the heat sink body 32. In one example, the bezel 48 can be fit to the heat sink body 32, such as press fit or snap fit to the heat sink body 32. Accordingly, attachment of the lens assembly 30 to the heat sink 22 can occupy less time compared to conventional luminaires that fasten a lens assembly to a heat sink with mechanical fasteners. For instance, the bezel 48 can include at least one first attachment member 49 such as a plurality of first attachment members 49. The heat sink body 32 can similarly include a complementary at least one second attachment member 51, such as a plurality of second attachment members 51. For instance, the second attachment members 51 can be carried by the inner surface 34*a*. The first and second attachment members 49 and 51 can be aligned with each other and can ride along each other as the bezel 48 is attached to the heat sink body 32.

In one example, the first and second attachment members 49 and 51 can be snap-fit together so as to attach the bezel 48 to the heat sink body 32. Accordingly, the first and second attachment members 49 and 51 can elastically deform from a respective first position to a respective second position as they ride along each other. Thus, it can be said that the heat sink body 32 and the bezel 48, and thus the lens assembly 30, can elastically deform as the lens assembly 30 is attached to the heat sink body 32. The first and second attachment members 49 and 51 can return to their respective first positions so as to secure the bezel 48, and thus the lens assembly 30, to the heat sink body 32. Alternatively, the first and second attachment members 49 and 51 can be press-fit together so as to press-fit the second driver cover 42 and the heat sink body 32 together. For instance, the first attachment member 44 can be press-fit in the second attachment member 46. Alternatively, the second attachment member 46 can be press-fit in the first attachment member 44. It should be appreciated, of course, that alternatively or additionally, the second driver cover 42 can be heat staked to the heat sink body 32, fastened to the heat sink body 32 using external mechanical fasteners, such as screws, or attached in any suitable alternative manner as desired.

The bezel 48 can be injection molded with the lens 50. The lens 50 can be made of a first plastic 45. Similarly, the bezel 48 can be made of a second plastic 47. Thus, the bezel 48 and the lens 50 can be injection molded as a single monolithic part. In one example illustrated in FIG. 5A, the first and second plastics 45 and 47 can be made from the same plastic material, and can thus be homogeneous with each other. Alternatively, as illustrated in FIG. 5B, the first plastic 45 can be made from a first plastic material, and the second plastic 47 can be made from a second plastic material different from the first plastic material. Thus, the lens assembly 30 can be a monolithic part that includes a co-injected heat sink body bezel 48 and the lens 50. For instance, the bezel 48 and the lens 50 can be injection molded as a single monolithic two-shot injection molded part, the first shot being defined by the first plastic material, and the second shot being defined by the second plastic material. One or both of the bezel 48 and the lens can be made from a thermoplastic. As described above, the lens 50 can be made from a plastic that is at least translucent or transparent. Similarly, the bezel 48 can be made from the plastic that is at least translucent or transparent, it being appreciated that the bezel 48 can be positioned radially outboard of the interior space 37 of the heat sink body 32. Alternatively, the plastic material of the bezel 48 can be less transparent than the plastic material of the lens 50. For instance, the plastic material of the bezel 48 can be opaque.

In another example, any of the components of the luminaire 20 can be 3-D printed. For instance, the components can include one or both of the heat sink 22, including the heat sink body 32 and the first driver cover 38, and the lens assembly 30, including the lens 50 and the bezel 48. The 3-D printed components can be made from the same plastic or of different plastics as described above. The first and second plastics can be the same plastic material or different plastic materials. In one exemplary fabrication of the component via 3-D printing, a user may prepare a data file that describes the shape of the desired of the component. The data file can then be used to direct the additive manufacture of the component by a 3-D printer. A data file may be generated by scanning an existing object, e.g., an existing component (or a model thereof). A data file may also be generated based on the specific dimensions that a user may desire for the resultant component. A data file may also be generated based on some combination of the foregoing.

As described above, the component can be 3-D printed as a single article or as multiple parts that are then assembled together. A data file may include information regarding dimensions of the component as well as information regarding the material or materials of the component. Thus, the component can be made from one material or from multiple materials. The component can be 3-D printed in a variety of methods. As one example, the component may be formed in an additive fashion by extruding plastic material, which material then hardens. Typically, a plastic filament wound on a coil is unreeled to supply material to an extrusion nozzle head, and the movement of the head is dictated by the data file that describes the component. Further background information may be found in, e.g., U.S. Pat. No. 8,827,684, the disclosure of which is hereby incorporated by reference as if set forth in its entirety herein. The component may also be formed by dispensing granular materials and then binding (e.g., via heat application) the dispensed granules. The component may also be formed by 3-D photopolymerization, in which technique liquid polymer is dispensed (e.g., via a dispensing head) and then exposed to controlled lighting so as to harden the exposed liquid polymer. A support plate (and/or the dispensing head) then moves in small increments and the liquid polymer is again exposed to light, and the process repeats until the desired part has been formed.

As described above, a user may 3-D print the component using a single material (e.g., a single plastic material, such as a thermoplastic) or with multiple plastic materials, such as first and second plastic materials. The component may include two or more different plastics, for instance defined by the heat sink body 32 and the first driver cover 38 when the component is the heat sink 22, or defined by the bezel 48 and the lens 50 when the component is the lens assembly 30. Thus, the different materials may be present in separate regions of the component. Alternatively, the different materials may be mixed together in a single region. To accomplish this, the user supplies the 3-D printing device with the necessary materials for fabrication of the component. As described above, a data file may be used to direct a 3-D printer to dispense different materials to different locations during printing or dispense different materials at different stages of the 3-D printing process.

Referring again to FIGS. 1A-1D, the LED panel 24 includes a substrate 52 that can be configured as a printed circuit board. The LED panel 24 further includes the at least one LED 28 supported by the substrate 52. In particular, the substrate 52 defines a first surface 52*a* that faces the first end 32*a* of the heat sink body 32, and a second surface 52*b* that faces the second end 32*b* of the heat sink body 32. The at least one LED 28 can be supported by the second surface 52*b*, such that illumination produced by the at least one LED 28 is directed toward the lens 50 during operation. The at least one LED 28 can be configured as a plurality of LEDs 28 that can be arranged in any manner as desired. For instance, the LEDs 28 can be arranged in at least one circumferential row such as a pair or more of circumferential rows.

In one example, the heat sink body 32 can define a shelf 54 that extends from the at least one side wall 34 toward the central axis 23. For instance, the shelf 54 can extend from the inner surface 34*a* toward the central axis 23. In one example, the shelf 54 can define an annulus. The substrate 52 can be supported, directly or indirectly, by the shelf 54. Thus, the second surface 52*b* of the substrate 52 can be seated against the shelf 54. In examples whereby the substrate 52 is supported directly by the shelf 54 as described below, the substrate 52 can be seated on the shelf 54.

With continuing reference to FIGS. 1A-1D and 7A, the luminaire 20 can further include a support plate 27 that can be attached to the heat sink 22. For instance, the support plate can be supported heat sink 22, and particular by the heat sink body 32. In one example, the support plate 27 is supported by the cross ribs 60, and further attached to the cross ribs 60. In another example, the support plate 27 can be supported by the shelf 54. The support plate 27 can, in turn, support the LED panel 24. In one example, the support plate 27 is thermally conductive, and made of the same plastic material as the heat sink body 32. It should be appreciated, of course, that the support plate 27 can be made of any alternative material or combination of materials suitable for attaching to the heat sink 22 and supporting the LED panel 24. The support plate 27 can define a first surface 27*a* the faces the first end 32*a* of the heat sink body 32, and a second surface 27*b* opposite the first surface 27*a*. Thus, the second surface 27*b* faces the second end 32*b*. The first surface 27*a* can be seated on the shelf 54, and the first surface 52*a* of the substrate 52 can be seated on the second surface 27*b*. Thus, the support plate 27 can be placed in thermal communication with the both the LED panel 24 and the heat sink 22. The support plate 27 can have a thermal conductivity sufficient so as to removing heat from the LED panel 24 and transfer the heat to the heat sink 22, thereby substantially assisting in maintaining the at least one LED 28 at the desired LED junction temperature.

Figure 6A:
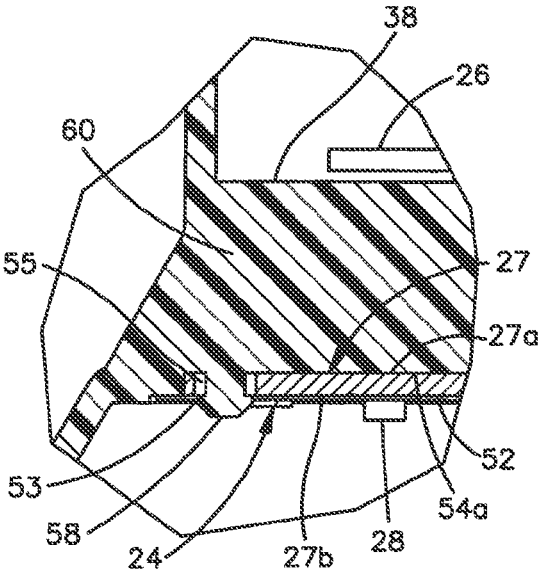
FIG. 6A is an enlarged sectional side view of a portion of the luminaire of FIG. 1A, showing a support plate and LED assembly supported by a heat sink body of the luminaire.
Figure 6B:
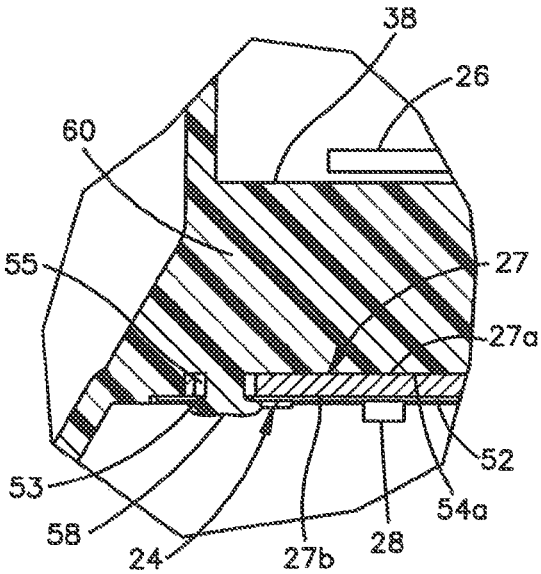
FIG. 6B is an enlarged sectional side elevation view of the portion of the luminaire of FIG. 6A, showing a support plate and an LED assembly attached to the heat sink body in accordance with another embodiment.

The support plate 27 and the substrate 52 can be supported by the heat sink 22, and in particular the heat sink body 32, in any manner as desired. For instance, referring now to FIG. 6A, the heat sink body 32 can be fit, such as snap-fit, to the support plate 27 and the substrate 52. Alternatively, as illustrated in FIG. 6B, the support plate 27 and the substrate 52 can be heat staked to the heat sink body 32. The support plate 27 can define an electrical aperture 59, such that the electrical conduit that places the driver 26 in electrical communication with the at least one LED passes through the electrical aperture 59. In one example, the substrate 52 defines a plurality of apertures 53 that extend from the first surface 52*a* to the second surface 52*b*. Similarly, the support plate 27 defines a plurality of apertures 55 that extend from the first surface 27*a* to the second surface 27*b*. When the substrate 52 is placed against the support plate 27, the apertures 53 and 55 can be aligned with each other. Further, the heat sink body 32, such as the cross ribs 60, can include a plurality of stakes 58 that are sized to extend through respective aligned pairs of the apertures 53 and 55. For instance, the stakes 58 extend from the cross ribs 60 in a direction parallel to the central axis 23 from the first end 32*a* toward the second end 32*b*. Once the stakes 58 extend through the respective apertures 53 and 55, heat can be applied to the free end of the stakes 58 that causes the free ends of each of the stakes 58 to deform, thereby capturing the support plate 27 and the substrate 52. It should be appreciated, of course, that the support plate 27 can be attached to the heat sink body 32 as desired. For instance, the support plate 27 can be press-fit to the heat sink body 32, snap-fit to the heat sink body 32, fastened to the heat sink body using one or more fasteners, such as screws, or any suitable fastener as desired.

The substrate 52 can alternatively be attached to the support plate 27. For instance, the substrate 52 can be attached to the support plate 27 by a thermally conductive paste or glue, can be heat staked by the support plate 27, press fit with the thermally conductive plate, fastened to the thermally conductive plate using fasteners, such as screws, or otherwise attached in any manner as desired. Alternatively, the substrate 52 can be attached directly to the heat sink body 32 in any manner as desired.

Figure 8A:
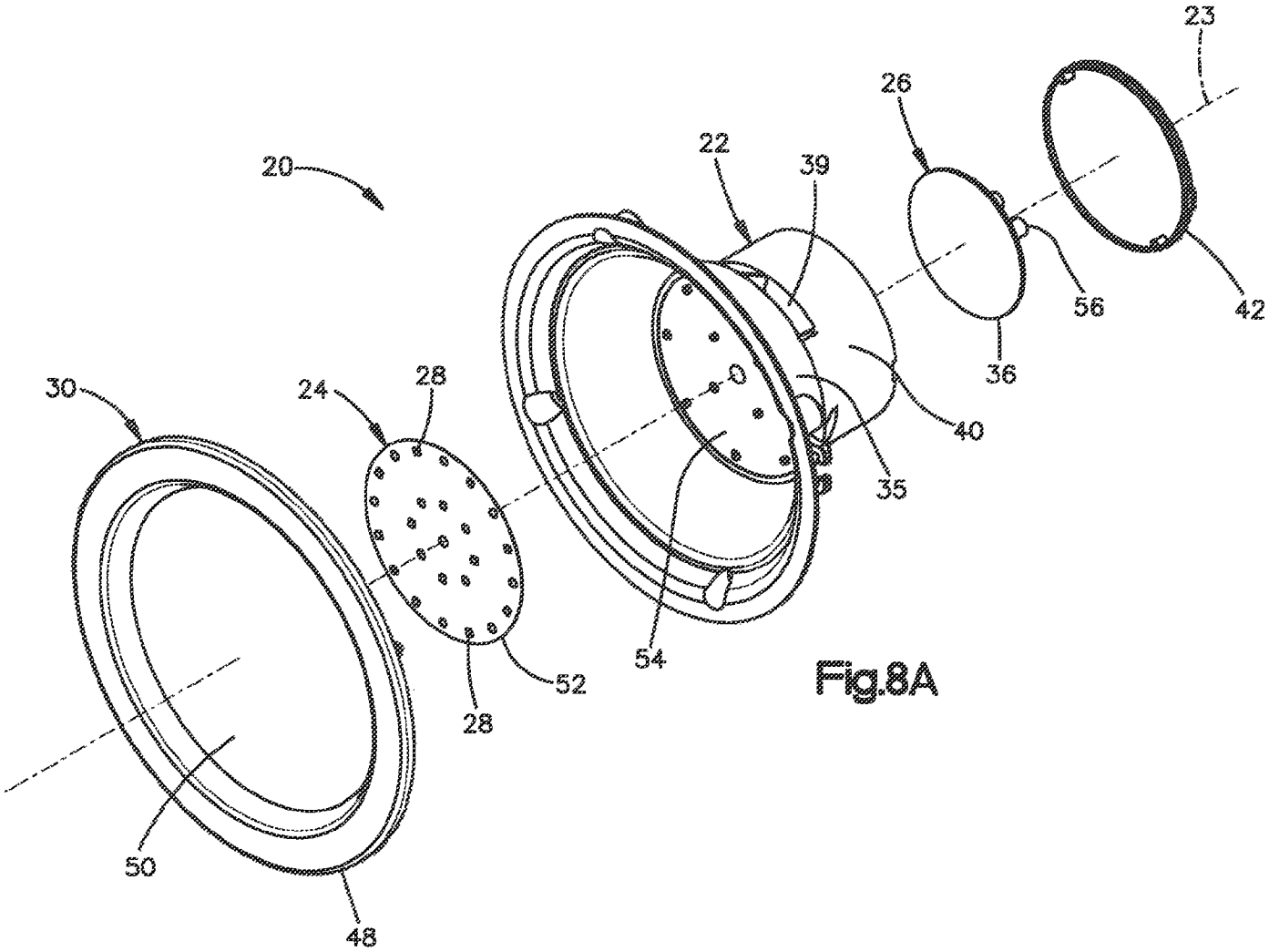
FIG. 8A is an exploded perspective view of a luminaire similar to the luminaire illustrated in FIG. 1A, but including a heat sink body having a divider wall.
Figure 8B:
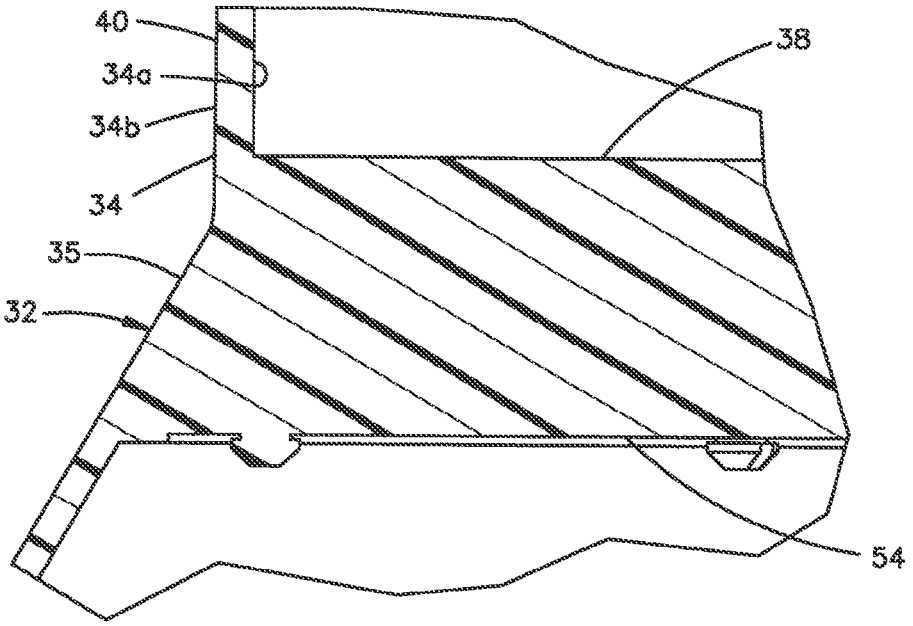
FIG. 8B is an enlarged sectional side elevation view of a portion of the luminaire of FIG. 8A, showing an LED panel supported by the divider wall.
Figure 8C:
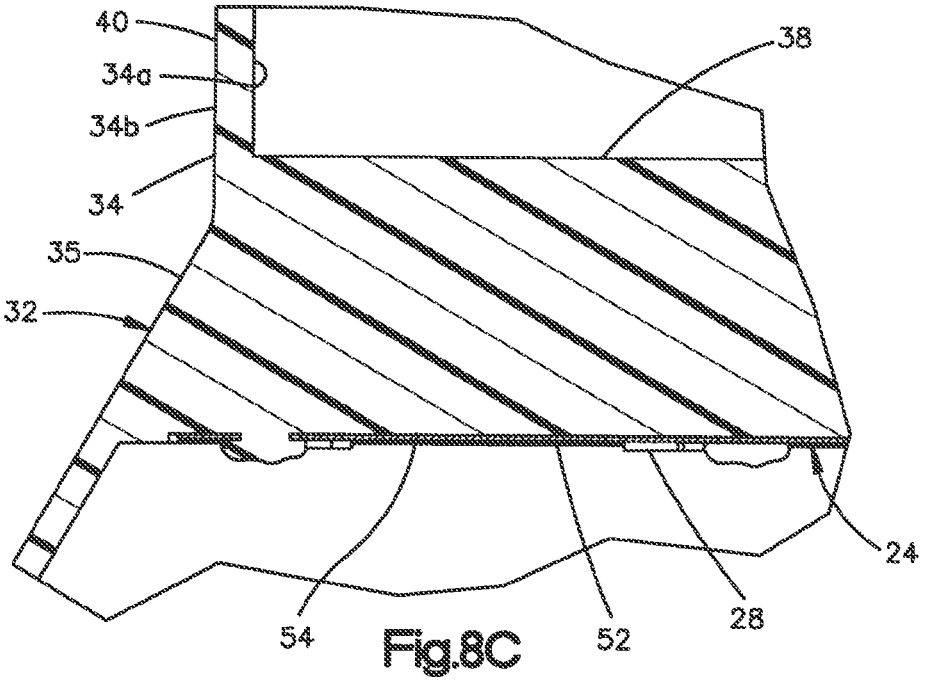
FIG. 8C is an enlarged sectional side elevation view of the portion of the luminaire of FIG. 8B, showing an LED panel attached to the divider wall.

Alternatively, referring to FIGS. 8A-8C, the shelf 54 can define a divider wall that extends substantially across an entirety of the interior space 37 along a cross-section of the heat sink that can be defined by a plane normal to the central axis 23. The divider wall can be homogeneous with the first driver cover 38. The shelf 54 can define a surface 54*a* that faces the second end 32*b* of the heat sink body 32. The shelf 54 can define the stakes 58 that extend from the surface 54*a* in a direction from the first end 32*a* toward the second end 32*b*. Thus, the substrate 52 can be seated on the shelf 54, such that the heat stakes 58 extend through respective ones of the apertures 53 of the substrate 52, and heat can be applied to the free end of the stakes 58 that causes the free ends of each of the stakes 58 to deform, thereby capturing the and the substrate 52 and securing the substrate 52 to the shelf 54. It should be appreciated, of course, that the substrate 52 can be attached to the heat sink body 32 as desired. For instance, the substrate 52 can be press-fit to the heat sink body 32, snap-fit to the heat sink body 32, fastened to the heat sink body using one or more fasteners, such as screws, or any suitable fastener as desired.

The support plate 27 can be constructed in accordance with any suitable embodiment as desired. For instance, the support plate 27 can be electrically conductive. In one example, an entirety of the support plate 27 can be metallic. Alternatively, an entirety of the support plate 27 can be plastic. In one example, the plastic can be a thermoplastic. The plastic can be electrically conductive or nonconductive as desired. In a further example, the support plate 27 can have a first portion 62*a* that is metallic, and a second portion 62*b* that plastic. The apertures 55 can extend through one or both of the first and second portions 62*a* and 62*b*.

Figure 7D:
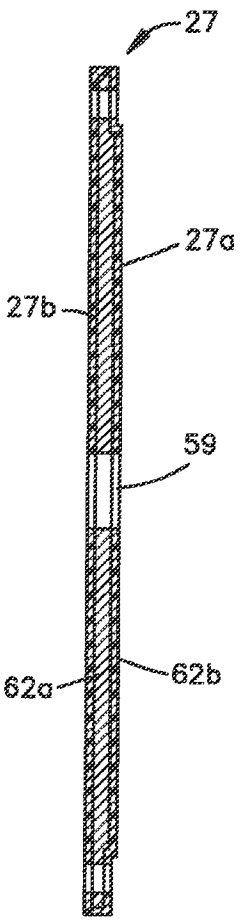
FIG. 7D is a sectional side elevation view of the support plate of FIG. 7A, constructed in accordance with yet another embodiment.
Figure 7C:
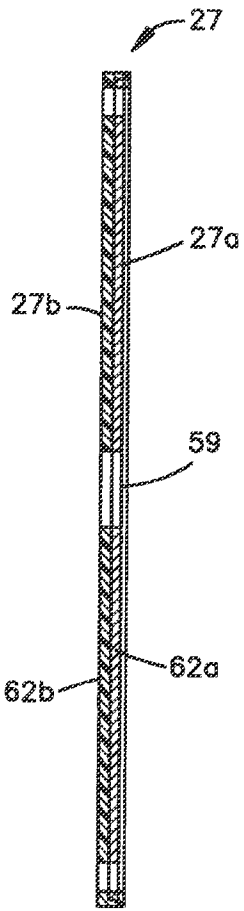
FIG. 7C is a sectional side elevation view of the support plate of FIG. 7A, constructed in accordance with another embodiment.
Figure 7B:
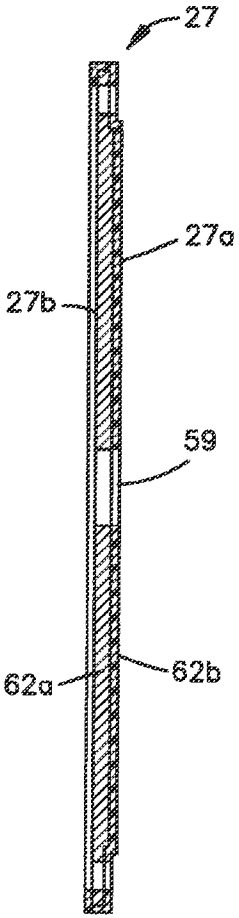
FIG. 7B is a sectional side elevation view of the support plate of FIG. 7A, constructed in accordance with one embodiment.
Figure 7A:
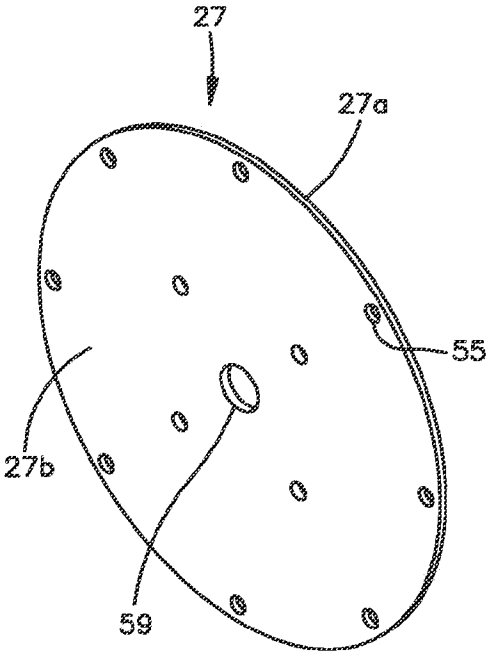
FIG. 7A is a perspective view of the support plate of FIG. 6A.

As illustrated in FIGS. 7B-7D, the metallic first portion 62*a* can be overmolded by the plastic of the second portion 62*b*. Alternatively, the metallic first portion 62*a* can be inserted into the plastic of the second portion 62*b*. As shown in FIG. 7B, the first surface 27*a* of the support plate 27 can be defined by the plastic second portion 62*b*, and the second surface 27*b* of the support plate 27 can be at least partially defined by the metallic first portion 62*a*. Alternatively, as illustrated in FIG. 7C, the first surface 27*a* of the support plate 27 can be defined by the metallic first portion 62*a*, and the second surface 27*b* of the support plate 27 can be defined by the plastic second portion 62*b*. Alternatively, as illustrated in FIG. 7D, the metallic first portion 62*a* can be substantially encapsulated by the plastic second portion 62*b*. Thus, the plastic first portion 62*a* can define both the first and second surfaces 27*a* and 27*b* of the support plate 27.

As described above, the first driver cover 38 can be monolithic with the heat sink body 32, such that the second end 32*b* is open. Thus, the LED panel 24 can be inserted through the second end 32*b* and into the interior space 37 of the heat sink body 32. Further, when the luminaire 20 includes the support plate 27, the support plate 27 can also be inserted into the interior space 37 through the second end 32*b*, in examples where the luminaire. Next, the lens assembly 30 can be attached to the second end 32*b*.

Alternatively, in some embodiments, the heat sink 22 can include the heat sink body 32 and the lens assembly 30 that tis monolithic with the second end 32*b* of the heat sink body 32. The first driver cover 38 can be separate from the heat sink body 32 and attached to the heat sink body 32 in any manner described herein. For instance, the first driver cover 38 can be snap-fit, press fit, heat staked, fastened, or otherwise attached to the heat sink body 32. Prior to attachment of the first driver cover 38 to the heat sink body 32, the LED panel 24 can be inserted into the interior space 37 of the heat sink body 32. It should be appreciated that the heat sink body 32 can be devoid of the cross ribs 60 and the shelf 54, as desired, such that the substrate of the LED panel 24 can be mounted to the inner surface 34*a* in any manner as desired, such as a press fit or a snap fit. The support plate 27, if present, can then be inserted into the interior space 37 and secured to the heat sink body 32 so as to support the LED panel 24. Alternatively, if the luminaire 20 does not include the support plate 27, the LED panel 24 can be secured directly to the heat sink body 32. The electrical conductor can be placed in electrical communication with the at least one LED 28, and the first driver cover 38 can then be secured to the first end 32*a* of the heat sink body 32. The driver 26 and second driver cover 42 can then be installed as described above.

It should thus be appreciated that methods can be provided for fabricating the luminaire 20 as described in accordance with any and all embodiments and examples as described above. For instance, one method can include the step of placing the driver 26 adjacent the first driver cover 38 that closes the first end 32*a* of the heat sink body 32. The first driver cover 38 can be monolithic with the heat sink body 32 as described above. The method can further include the step of attaching the second driver cover 42 to the heat sink body 32 such that the driver 26 is contained between the first driver cover 38 and the second driver cover 42. The method can further include the step of inserting the LED panel 24 through the second end 32*b* of the heat sink body 32 that is opposite the first end 32*a*, the LED panel 24 including the substrate 52 and at least one LED 28 supported by the substrate 52. The method can further include the step of placing the at least one LED 28 in electrical communication with the driver 26. The method can further include, after the inserting step, the step of mounting the substrate 52 to the heat sink body 32 such that the substrate 52 is supported by the heat sink body 32 at a location such that the first driver cover 38 is disposed between the LED panel 24 and the driver 26. The method can further include the step of fabricating the lens assembly 30 such that the lens 50 is monolithic with the bezel 48. The method can further include the step of mounting the lens assembly 30 to the second end 32*b* of the heat sink body 32.

Another method for fabricating the luminaire 20 can include the step of inserting the LED panel 24 through an open end of a heat sink, which can be defined by the second end 32*b*. The LED panel 24 can include the substrate 52 and the at least one LED 28 supported by the substrate 52 as described above. The method can further include the step of placing the at least one LED in electrical communication with the driver 26. The method can further include, after the inserting step, mounting the substrate 52 to the heat sink 22. The method can further include the step of attaching the bezel 48 to the open end of the heat sink 22, such that the lens 50 that is monolithic with the bezel 48 closes the open end of the heat sink 22 and is positioned to allow illumination produced by the at least one LED 28 to pass through and out the luminaire 20. The method can further include the step of fabricating the heat sink body 32 having the first driver cover 38 that closes the first end 32*a* and is monolithic with the heat sink body 32. The method can further include the step of the driver 26 adjacent the first driver cover 38, and attaching the second driver cover 42 to the first end 32*a* such that the driver 26 is contained between the first driver cover 38 and the second driver cover 42. The method can further include the step of placing the driver 26 in electrical communication with the at least one LED 28. The step of mounting the substrate 52 can include the step of mounting the substrate 52 to the heat sink 22 at a location such that the first driver cover 38 is disposed between the LED panel 24 and the driver 26.

Another method for fabricating the luminaire 20 can include the step of placing the driver 26 adjacent the first driver cover 38 that is supported by the heat sink body 32 at the first end 32*a*. The method can further include the step of fitting the second driver cover 42 to the first end 32*a* so as to contain the driver 26 between the first driver cover 38 and the second driver cover 42. The method can further include the step of inserting the LED panel 24 through the open second end 32*b* opposite the first end 32*a*. The method can further include the step of supporting the substrate 52 in the heat sink body 32 at a location such that the first driver cover 38 separates the LED panel 24 from the driver 26. The method can further include the step of placing the at least one LED 28 in electrical communication with the driver 26. The method can further include the step of fitting the lens assembly 30 to the second end 32*b* of the heat sink body 32, such that illumination produced by the at least one LED 28 passes through and out the luminaire 20. The step of fitting the second driver cover 42 can include the step of causing both the second driver cover 42 and the heat sink body 32 to elastically deform as the second driver cover 42 attaches to the heat sink body 32. The step of fitting the lens assembly 30 can include the step of causing both the bezel 48 and the heat sink body 32 to elastically deform as the bezel 48 attaches to the heat sink body 32. The step of fitting the second driver cover 42 to the first end 32*a* can include the step of press-fitting the second driver cover 42 to the first end 32*a*.

During operation of the luminaire 20, as heat is produced by the LED panel 24, and in particular by the LEDs 28, heat from the LEDs 28 can travel through the substrate 52, through the support plate 27 if present, and to the heat sink 22 via thermal conduction. Alternatively or additionally, heat from the LEDs 28 can travel to the heat sink 22 via convection. The heat sink 22 dissipates the heat into the ambient environment through the apertures 39, or via thermal conduction through the heat sink 22.

It should be appreciated that the present disclosure can include any one up to all of the following examples:

Example 1

A luminaire comprising:

a plastic heat sink body that defines a first end, and a second end opposite the first end along a central axis;

a first driver cover that at least substantially closes the first end;

a driver configured to receive input electrical power from an electrical power source, and output electrical power;

a second driver cover attached to the heat sink body, such that the driver is contained between the first driver cover and the second driver cover;

an LED panel including a substrate supported by the heat sink body at a location such that the first driver cover is disposed between the LED panel and the driver, and at least one LED carried by the substrate, wherein the at least one LED is in electrical communication with the driver so as to receive the output electrical power and, in response, produce illumination; and a lens assembly supported by the heat sink body at the second end so as to at least substantially close the second end, such that at least a portion of the illumination passes through the lens assembly and out the luminaire, wherein one of the first driver cover and the lens assembly is monolithic with the heat sink body at a respective one of the first and second ends, such that the LED panel is configured for insertion into the heat sink body at the other of the first and second ends.

Example 2

The luminaire as recited in example 1, wherein the first driver cover is monolithic with the heat sink body at the first end, such that the LED panel is configured for insertion into the heat sink body at the second end.

Example 3

The luminaire as recited in example 1, wherein the lens assembly comprises a diffuser.

Example 4

The luminaire as recited in example 3, wherein the lens assembly further comprises a bezel that is supported by the heat sink body at the second end, wherein an outer periphery of the diffuser is supported by bezel.

Example 5

The luminaire as recited in example 4, wherein the diffuser is monolithic with the bezel.

Example 6

The luminaire as recited in any one of examples 4 to 5, wherein the diffuser comprises a first plastic material, and the bezel comprises a second material that is different than the first plastic material.

Example 7

The luminaire as recited in any one of examples 4 to 5, wherein the diffuser and the bezel comprise the same plastic material.

Example 8

The luminaire as recited in any one of the preceding examples, wherein the substrate is at least one of press-fit into heat sink body, snapped into the heat sink body, heat staked by the heat sink body, and fastened to the heat sink body.

Example 9

The luminaire as recited in example 8, wherein the heat sink body defines a shelf that extends from the side wall toward the central axis, and the substrate is supported by the shelf.

Example 10

The luminaire as recited in example 8, wherein the substrate is seated against the shelf.

Example 11

The luminaire as recited in any one of examples 9 to 10, wherein the shelf defines a support plate that extends substantially across an entirety of a cross-section of the heat sink body.

Example 12

The luminaire as recited in any one of examples 9 to 11, wherein the shelf is attached to the substrate of the LED panel.

Example 13

The luminaire as recited in any one of examples 1 to 12, wherein the heat sink body further comprises at least one side wall that extends from the first end to the second end, and at least one aperture that extends through the side wall.

Example 14

The luminaire as recited in the example 3, wherein the at least one aperture comprises a plurality of apertures that extend through the side wall.

Example 15

The luminaire as recited in the example 4, wherein the plurality of apertures are spaced from each other about the central axis.

Example 16

The luminaire as recited in in any one of examples 13 to 15, wherein at least a portion of the at least one aperture is disposed between the LED panel and the first driver cover with respect to a direction defined by an orientation of the central axis.

Example 17

The luminaire as recited in the example 16, wherein an entirety of the at least one aperture is disposed between the LED panel and the first driver cover with respect to the direction defined by an orientation of the central axis.

Example 18

The luminaire as recited in any one of examples 1 to 12, wherein the heat sink body further comprises at least one side wall that extends from the first end to the second end, and the at least one side wall is substantially solid and continuous about the central axis from a first location radially aligned with the first driver cover to a second location radially aligned with the LED panel.

Example 19

The luminaire as recited in the example 18, wherein the at least one side wall is substantially solid and continuous about the central axis from the first location to the second end of the heat sink body.

Example 20

The luminaire as recited in any one of examples 1 to 8, further comprising a support plate in thermal communication with the both the LED panel and the heat sink body.

Example 21

The luminaire as recited in example 20, wherein the heat sink body defines a shelf that extends from the side wall toward the central axis and the support plate is supported by the shelf.

Example 22

The luminaire as recited in example 21, wherein the support plate is seated against the shelf.

Example 23

The luminaire as recited in any one of examples 20 to 22, wherein the support plate is one of press-fit inside the heat sink body, heat staked by the heat sink body, snapped into the heat sink body, and fastened to the heat sink body.

Example 24

The luminaire as recited in any one of examples 20 to 23, wherein at least a portion of the support plate is electrically conductive.

Example 25

The luminaire as recited in example 24, wherein the at least a portion of the support plate is metallic.

Example 26

The luminaire as recited in example 25, wherein an entirety of the support plate is metallic.

Example 27

The luminaire as recited in example 25, wherein a second portion of the support plate comprises a thermally conductive plastic.

Example 28

The support plate as recited in example 27, wherein the support plate comprises a metallic body overmolded by the thermally conductive plastic.

Example 29

The luminaire as recited in any one of examples 20 to 28, wherein the substrate defines a second face that faces the lens, and a first face opposite the second face, and the first face is seated on the support plate.

Example 30

The luminaire as recited in any one of examples 20 to 29, wherein the heat sink body further comprises at least one side wall that extends from the first end to the second end, and at least one aperture that extends through the side wall.

Example 31

The luminaire as recited in example 30, wherein the at least one aperture comprises a plurality of apertures that extend through the side wall.

Example 32

The luminaire as recited in example 31, wherein the plurality of apertures are spaced from each other about the central axis.

Example 33

The luminaire as recited in in any one of examples 30 to 32, wherein at least a portion of the at least one aperture is disposed between the support plate and the first driver cover with respect to a direction defined by an orientation of the central axis.

Example 34

The luminaire as recited in example 33, wherein an entirety of the at least one aperture is disposed between the support plate and the first driver cover with respect to the direction defined by an orientation of the central axis.

Example 35

The luminaire as recited in any one of examples 19 to 28, wherein the heat sink body further comprises at least one side wall that extends from the first end to the second end, and the at least one side wall is substantially solid and continuous about the central axis from a first location radially aligned with the first driver cover to a second location radially aligned with the support plate.

Example 36

The luminaire as recited in example 35, wherein the at least one side wall is substantially solid and continuous about the central axis from the first location to the second end of the heat sink body.

Example 37

The luminaire as recited in any one of the preceding examples, wherein the first end comprises a flange that surrounds the first driver cover and projects out with respect to the first driver cover a depth sufficient to receive the driver, and the second driver cover is secured to the flange.

Example 38

The luminaire as recited in example 37, wherein the flange projects out with respect to the first driver cover along a direction from the second end toward the first end.

Example 39

The luminaire as recited in any one of the preceding examples, wherein the driver comprises a printed circuit board and driver electronics supported by the printed circuit board, the driver electronics in electrical communication with the at least one LED.

Example 40

The luminaire as recited in any one of the preceding examples, wherein the first driver cover comprises a plastic.

Example 41

The luminaire as recited in example 40, wherein the first driver cover comprises the same thermoplastic as the heat sink body.

Example 42

The luminaire as recited in any one of the preceding examples, wherein the first driver cover mechanically isolates the driver from the LED panel.

Example 43

The luminaire as recited in any one of the preceding examples, wherein the first end has a first cross sectional dimension perpendicular to the central axis, and the second end has a second cross sectional dimension perpendicular to the central axis, the second cross sectional dimension greater than the first cross sectional dimension.

Example 44

The luminaire as recited in example 43, wherein the first end defines a first round cross-section along a plane that is normal to the central axis.

Example 45

The luminaire as recited in example 44, wherein the first round cross section is circular.

Example 46

The luminaire as recited in any one of examples 44 to 45, wherein the second end defines a second round cross-section along a respective plane that is normal to the central axis.

Example 47

The luminaire as recited in example 46, wherein the second round cross-section is circular.

Example 48

The luminaire as recited in any one of the preceding examples, wherein at least a portion of the heat sink body comprises a plastic material having an in-plane thermal conductivity in a range between and including approximately 1 W/m-k and approximately 20 W/m-k in-plane.

Example 49

The luminaire as recited in example 48, wherein an entirety of the heat sink body comprises the plastic material.

Example 50

The luminaire as recited in example 48, wherein at least portion of the heat sink body is a thermoplastic having an in-plane thermal conductivity between and including approximately 0.05 W/m-k and approximately 0.50 W/m-k.

Example 51

A method of fabricating a luminaire, the method comprising the steps of:

placing a driver adjacent a driver cover that closes the first end of a plastic heat sink body and is monolithic with the plastic heat sink body;

attaching a second driver cover to the heat sink body such that the driver is contained between the first driver cover and the second driver cover; and inserting an LED panel through a second end of the plastic heat sink body that is opposite the first end, the LED panel including a substrate and at least one LED supported by the substrate;

placing the at least one LED in electrical communication with the driver; and after the inserting step, mounting the substrate to the heat sink body such that the substrate is supported by the heat sink body at a location such that the first driver cover is disposed between the LED panel and the driver.

Example 52

The method as recited in example 51, further comprising:

fabricating a lens assembly including a bezel and a lens supported at its outer periphery by the bezel and monolithic with the bezel; and mounting the lens assembly to the second end of the heat sink body.

Example 53

The method as recited in any one of examples 51 to 52, further comprising the step of fabricating the luminaire as recited in any one of examples 7 to 49.

Example 54

A luminaire comprising:

a heat sink that defines a first end and an open second end opposite the first end along a central axis;

a driver configured to receive input electrical power from an electrical power source, and output electrical power;

an LED panel including a substrate supported by the heat sink body, and at least one LED carried by the substrate, wherein the at least one LED is in electrical communication with the driver so as to receive the output electrical power and, in response, produce illumination; and a lens assembly that closes the open second end of the heat sink, the lens assembly including a bezel that is supported by the second end of the heat sink, and a lens that is supported at its periphery by the bezel and monolithic with the bezel, wherein an entirety of the lens assembly comprises a plastic configured to emit at least a portion of the illumination produced by the at least one LED.

Example 55

The luminaire as recited in example 54, wherein the lens comprises a diffuser.

Example 56

The luminaire as recited in any one of examples 54 to 55, wherein the lens comprises a first plastic material, and the bezel comprises a second plastic material that is different than the first plastic material.

Example 57

The luminaire as recited in example 56, wherein the second plastic material is less transparent than the first plastic material.

Example 58

The luminaire as recited in any one of examples 54 to 55, wherein the diffuser and the bezel comprise the same plastic material.

Example 59

The luminaire as recited in any one of examples 54 to 58, wherein the first end of the heat sink is open, and the heat sink comprises 1) a plastic heat sink body that defines the first and second ends, and 2) a first driver cover that is monolithic with the heat sink body and substantially closes the first end.

Example 60

The luminaire as recited in example 59, further comprising a second driver cover attached to the heat sink body, such that the driver is contained between the first driver cover and the second driver cover.

Example 61

The luminaire as recited in any one of examples 59 to 60, wherein the first driver cover comprises the same material as the heat sink body.

Example 62

The luminaire as recited in any one of examples 54 to 61, wherein the substrate is at least one of press-fit into heat sink body, snapped into the heat sink body, heat staked by the heat sink body, and fastened to the heat sink body.

Example 63

The luminaire as recited in example 62, wherein the heat sink body defines a shelf that extends from the side wall toward the central axis, and the substrate is supported by the shelf.

Example 64

The luminaire as recited in example 63, wherein the substrate is seated against the shelf.

Example 65

The luminaire as recited in any one of examples 63 to 64, wherein the shelf defines a divider wall that extends substantially across an entirety of a cross-section of the heat sink.

Example 66

The luminaire as recited in any one of examples 63 to 65, wherein the shelf is monolithic with the heat sink body and comprises a thermally conductive plastic.

Example 67

The luminaire as recited in any one of examples 54 to 66, wherein the heat sink body further comprises at least one side wall that extends from the first end to the second end, and at least one aperture that extends through the side wall.

Example 68

The luminaire as recited in example 67, wherein the at least one aperture comprises a plurality of apertures that extend through the side wall.

Example 69

The luminaire as recited in example 68, wherein the plurality of apertures are spaced from each other about the central axis.

Example 70

The luminaire as recited in in any one of examples 67 to 69, wherein at least a portion of the at least one aperture is disposed between the LED panel and the first driver cover with respect to a direction defined by an orientation of the central axis.

Example 71

The luminaire as recited in example 70, wherein an entirety of the at least one aperture is disposed between the LED panel and the first driver cover with respect to the direction defined by an orientation of the central axis.

Example 72

The luminaire as recited in any one of examples 54 to 66, wherein the heat sink body further comprises at least one side wall that extends from the first end to the second end, and the at least one side wall is substantially solid about the central axis from a first location radially aligned with the first driver cover to a second location radially aligned with the LED panel.

Example 73

The luminaire as recited in example 72, wherein the at least one side wall is substantially solid about the central axis from the first location to the second end of the heat sink.

Example 74

The luminaire as recited in any one of examples 54 to 62, further comprising a support plate in thermal communication with the both the LED panel and the heat sink.

Example 75

The luminaire as recited in example 74, wherein the heat sink body defines a shelf that extends from the side wall toward the central axis and the support plate is supported by the shelf.

Example 76

The luminaire as recited in example 75, wherein the support plate is seated against the shelf.

Example 77

The luminaire as recited in any one of examples 74 to 76, wherein the support plate is one of press-fit inside the heat sink body, heat staked by the heat sink body, snapped into the heat sink body, and fastened to the heat sink body.

Example 78

The luminaire as recited in any one of examples 74 to 77, wherein at least a portion of the support plate is electrically conductive.

Example 79

The luminaire as recited in example 78, wherein the at least a portion of the support plate is metallic.

Example 80

The luminaire as recited in example 79, wherein an entirety of the support plate is metallic.

Example 81

The luminaire as recited in example 79, wherein a second portion of the support plate comprises a thermally conductive plastic.

Example 82

The luminaire as recited in example 81, wherein the support plate comprises a metallic body overmolded by the thermally conductive plastic.

Example 83

The luminaire as recited in any one of examples 74 to 82, wherein the substrate defines a second face that faces the lens, and a first face opposite the second face, and the first face is seated on the support plate.

Example 84

The luminaire as recited in any one of examples 74 to 83, wherein the heat sink body further comprises at least one side wall that extends from the first end to the second end, and at least one aperture that extends through the side wall.

Example 85

The luminaire as recited in example 84, wherein the at least one aperture comprises a plurality of apertures that extend through the side wall.

Example 86

The luminaire as recited in example 85, wherein the plurality of apertures are spaced from each other about the central axis.

Example 87

The luminaire as recited in in any one of examples 84 to 86, wherein at least a portion of the at least one aperture is disposed between the support plate and the first driver cover with respect to a direction defined by an orientation of the central axis.

Example 88

The luminaire as recited in example 87, wherein an entirety of the at least one aperture is disposed between the support plate and the first driver cover with respect to the direction defined by an orientation of the central axis.

Example 89

The luminaire as recited in any one of examples 74 to 83, wherein the heat sink body further comprises at least one side wall that extends from the first end to the second end, and the at least one side wall is substantially solid about the central axis from a first location radially aligned with the first driver cover to a second location radially aligned with the support plate.

Example 90

The luminaire as recited in example 89, wherein the at least one side wall is substantially solid about the central axis from the first location to the second end of the heat sink.

Example 91

The luminaire as recited in any one of examples 54 to 90, wherein the first end comprises a flange that projects out from the first driver cover a depth sufficient to receive the driver, and the second driver cover is secured to the flange.

Example 92

The luminaire as recited in example 91, wherein the flange is disposed radially outboard from an outer periphery of the first driver cover.

Example 93

The luminaire as recited in example 92, wherein the flange projects out with respect to the first driver cover along a direction from the second end toward the first end.

Example 94

The luminaire as recited in any one of examples 54 to 93, wherein the driver comprises a printed circuit board and driver electronics supported by the printed circuit board, the driver electronics in electrical communication with the at least one LED.

Example 95

The luminaire as recited in any one of examples 54 to 94, wherein the first end has a first cross sectional dimension perpendicular to the central axis, and the second end has a second cross sectional dimension perpendicular to the central axis, the second cross sectional dimension greater than the first cross sectional dimension.

Example 96

The luminaire as recited in example 95, wherein the first end defines a first round cross-section along a plane that is normal to the central axis.

Example 97

The luminaire as recited in example 96, wherein the first round cross section is circular.

Example 98

The luminaire as recited in any one of examples 96 to 97, wherein the second end defines a second round cross-section along a respective plane that is normal to the central axis.

Example 99

The luminaire as recited in example 98, wherein the second round cross-section is circular.

Example 100

The luminaire as recited in any one of examples 54 to 99, wherein at least a portion of the heat sink body comprises a plastic material having an in-plane a thermal conductivity in the range of approximately 1 W/m-k and approximately 20 W/m-k.

Example 101

The luminaire as recited in example 100, wherein an entirety of the heat sink body comprises the plastic material.

Example 102

The luminaire as recited in example 100, wherein a portion of the heat sink body has an in-plane a thermal conductivity between and including approximately 0.05 W/m-k and approximately 50 W/m-k Example 103

A method of fabricating a luminaire, the method comprising the steps of:

inserting an LED panel through an open end of a heat sink, the LED panel including a substrate and at least one LED supported by the substrate;

placing the at least one LED in electrical communication with a driver; and after the inserting step, mounting the substrate to the heat sink; and attaching a bezel of a lens assembly to the open end of the heat sink, such that a lens that is monolithic with the bezel closes the open end of the heat sink and is positioned to allow illumination produced by the at least one LED to pass through and out the luminaire.

Example 104

The method as recited in example 103, wherein the heat sink comprises a thermoplastic heat sink body that defines a first end, and the end is a second end of the heat sink body opposite the first end, the method comprising fabricating the heat sink body having a first driver cover that closes the first end of a thermoplastic heat sink body and is monolithic with the thermoplastic heat sink body.

Example 105

The method as recited in example 104, further comprising the steps of:

placing a driver adjacent the first driver cover;

attaching a second driver cover to the first end such that the driver is contained between the first driver cover and the second driver cover; and placing the driver in electrical communication with the at least one LED.

Example 106

The method as recited in example 104, wherein the mounting step comprises mounting the substrate to the heat sink at a location such that the first driver cover is disposed between the LED panel and the driver.

Example 107

A luminaire comprising:

a heat sink body that defines a first end, a second end opposite the first end along a central axis;

a first driver cover supported at the first end of the heat sink body, wherein the first driver cover substantially closes the first end;

a driver configured to receive input electrical power from an electrical power source, and output electrical power;

a second driver cover attached to the heat sink body, such that the driver is contained between the first driver cover and the second driver cover;

an LED panel including a substrate supported by the heat sink body at a location such that the first driver cover is disposed between the LED panel and the driver, and at least one LED carried by the substrate, wherein the at least one LED is in electrical communication with the driver so as to receive the output electrical power and, in response, produce illumination; and a lens assembly supported by the heat sink at the second end, such that at least a portion of the illumination passes through the lens assembly and out the luminaire, wherein each of the second driver cover and the lens assembly is configured to be fit to the heat sink body so as to attach 1) the second driver cover to the first end of the heat sink body, and 2) the lens assembly to the second end of the heat sink body.

Example 108

The luminaire as recited in example 107, wherein at least one of 1) the heat sink body and the second driver cover are configured to elastically deform as the second driver cover is attached to the heat sink body, and 2) the heat sink body and the lens assembly are configured to elastically deform as the lens assembly is attached to the heat sink body.

Example 109

The luminaire as recited in any one of examples 108 and 107, wherein at least one of 1) the heat sink body and the second driver cover are press-fit so as to attach the second driver cover to the heat sink body, and 2) the heat sink body and the lens assembly are press fit so as to attach the lens assembly to the heat sink body.

Example 110

The luminaire as recited in example 109, wherein the lens assembly comprises a bezel and a lens supported by the bezel, and the bezel is attached to the heat sink body.

Example 111

The luminaire as recited in example 110, wherein the bezel elastically deforms as the lens assembly is attached to the heat sink body.

Example 112

The luminaire as recited in any one of examples 107 and 111, wherein the first driver cover is monolithic with the heat sink body.

Example 113

The luminaire as recited in any one of examples 110 and 112, wherein the bezel is monolithic with the lens.

Example 114

The luminaire as recited in any one of examples 107 to 113, wherein the heat sink body comprises a plastic.

Example 115

A method for assembling a luminaire, the method comprising the steps of:

placing a driver adjacent a first driver cover that is supported by a heat sink body at a first end of the heat sink body;

fitting a second driver cover to the first end of the heat sink body so as to contain the driver between the first driver cover and the second driver cover;

inserting an LED panel through an open second end of the heat sink opposite the first end, the LED panel including a substrate and at least one LED supported by the substrate;

supporting the substrate in the heat sink body at a location such that the first driver cover separates the LED panel from the driver;

placing the at least one LED in electrical communication with the driver; and fitting a lens assembly to the second end of the heat sink, such that illumination produced by the at least one LED passes through and out the luminaire.

Example 116

The method as recited in example 115, wherein the step of fitting the second driver cover comprises causing both the second driver cover and the heat sink body to elastically deform as the second driver cover attaches to the heat sink body.

Example 117

The method as recited in any one of examples 115 to 116, wherein the lens assembly comprises a bezel and a lens monolithic with the bezel, and the step of fitting the lens assembly comprises causing both the bezel and the heat sink body to elastically deform as the bezel attaches to the heat sink body.

Example 118

The method as recited in example 115, wherein the step of fitting the second driver cover comprises press-fitting the second driver cover and the heat sink body together so as to attach the second driver cover to the heat sink body.

Example 119

A heat sink for a luminaire, the heat sink comprising: a plastic heat sink body that includes a side wall having an open first end and an open second end opposite the open first end;

a driver cover monolithic with the heat sink body so as to substantially close the first end, such that the side wall extends beyond the driver cover in a direction from the second end to the first end so as to define a driver cavity sized to receive an LED driver, wherein the driver cover defines at least one aperture sized to receive an electrical conduit that is in electrical communication with the driver and is configured to place at least one LED in electrical communication with the LED driver.

Example 120

A lens assembly configured to close an end heat sink of a luminaire, the lens assembly comprising:

a plastic bezel configured to attach to an open end of the luminaire, wherein the plastic bezel encloses an interior; and a plastic diffuser monolithic with the plastic bezel so as to extend along an entirety of the interior, such that when the lens assembly closes the end of the heat sink, the plastic diffuser is configured to allow illumination from the luminaire to pass through.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the invention as described herein, and changes may be made without departing from the spirit and scope of the invention, for instance as set forth by the appended claims.

What is claimed:

1. A luminaire comprising:

a plastic heat sink body that defines a first end, and a second end opposite the first end along a central axis, a first driver cover that at least substantially closes the first end;

a driver configured to receive input electrical power from an electrical power source, and output electrical power;

a second driver cover attached to the heat sink body, such that the driver is contained between the first driver cover and the second driver cover; and an LED panel including a substrate supported by the heat sink body at a location such that the first driver cover is disposed between the LED panel and the driver, and at least one LED carried by the substrate, wherein the at least one LED is in electrical communication with the driver so as to receive the output electrical power and, in response, produce illumination; and a lens assembly supported by the heat sink body at the second end so as to at least substantially close the second end, such that at least a portion of the illumination passes through the lens assembly and out the luminaire, wherein one of the first driver cover and the lens assembly is monolithic with the heat sink body at a respective one of the first and second ends, such that the LED panel is configured for insertion into the heat sink body at the other of the first and second ends, wherein the lens assembly further comprises a diffuser and a bezel that is supported by the heat sink body at the second end, wherein an outer periphery of the diffuser is supported by bezel, and the diffuser is monolithic with the bezel.

2. The luminaire as recited in claim 1, wherein the first driver cover is monolithic with the heat sink body at the first end, such that the LED panel is configured for insertion into the heat sink body at the second end.

3. The luminaire as recited in claim 1, further comprising a support plate in thermal communication with the both the LED panel and the heat sink body, wherein at least a portion of the support plate is electrically conductive.

4. The luminaire as recited in claim 1, wherein the first driver cover mechanically isolates the driver from the LED panel.

5. The luminaire as recited in claim 1, wherein the heat sink body comprises a plastic material having an in-plane thermal conductivity in a range between and including approximately 1 W/m-k and approximately 20 W/m-k in-plane.

6. The luminaire as recited in claim 1, wherein the heat sink body comprises a thermoplastic having an in-plane thermal conductivity between and including approximately 0.05 W/m-k and approximately 0.50 W/m-k.

7. A method of fabricating a luminaire, the method comprising the steps of:

placing a driver adjacent a driver cover that closes the first end of a plastic heat sink body and is monolithic with the plastic heat sink body;

attaching a second driver cover to the heat sink body such that the driver is contained between the first driver cover and the second driver cover; and inserting an LED panel through a second end of the plastic heat sink body that is opposite the first end, the LED panel including a substrate and at least one LED supported by the substrate;

placing the at least one LED in electrical communication with the driver; and after the inserting step, mounting the substrate to the heat sink body such that the substrate is supported by the heat sink body at a location such that the first driver cover is disposed between the LED panel and the driver, further comprising the step of fabricating a lens assembly including a bezel and a lens supported at its outer periphery by the bezel and monolithic with the bezel, and mounting the lens assembly to the second end of the heat sink body.

8. A luminaire comprising:

a heat sink that defines a first end and an open second end opposite the first end along a central axis;

a driver configured to receive input electrical power from an electrical power source, and output electrical power;

an LED panel including a substrate supported by the heat sink, and at least one LED carried by the substrate, wherein the at least one LED is in electrical communication with the driver so as to receive the output electrical power and, in response, produce illumination; and a lens assembly that closes the open second end of the heat sink, the lens assembly including a bezel that is supported by the second end of the heat sink, and a lens that is supported at its periphery by the bezel and monolithic with the bezel, wherein an entirety of the lens assembly comprises a plastic configured to emit at least a portion of the illumination produced by the at least one LED.

9. The luminaire as recited in claim 8, wherein the lens comprises a first plastic material, and the bezel comprises a second plastic material that is different than the first plastic material.

10. The luminaire as recited in claim 8, wherein the first end of the heat sink is open, and the heat sink comprises 1) a plastic heat sink body that defines the first and second ends, and 2) a first driver cover that is monolithic with the heat sink body and substantially closes the first end.

11. The luminaire as recited in claim 8, wherein the heat sink comprises a plastic material having an in-plane a thermal conductivity in the range of approximately 1 W/m-k and approximately 20 W/m-k.

12. The luminaire as recited in claim 8, wherein the heat sink body has an in-plane a thermal conductivity between and including approximately 0.05 W/m-k and approximately 50 W/m-k.

13. A method of fabricating a luminaire, the method comprising the steps of:

inserting an LED panel through an open end of a heat sink, the LED panel including a substrate and at least one LED supported by the substrate;

placing the at least one LED in electrical communication with a driver; and after the inserting step, mounting the substrate to the heat sink; and attaching a bezel of a lens assembly to the open end of the heat sink, such that a lens that is monolithic with the bezel closes the open end of the heat sink and is positioned to allow illumination produced by the at least one LED to pass through and out the luminaire.

14. The method as recited in claim 13, wherein the heat sink comprises a thermoplastic heat sink body that defines a first end and a second end opposite the first end, the method comprising fabricating the heat sink body having a first driver cover that closes the first end of a thermoplastic heat sink body and is monolithic with the thermoplastic heat sink body.

15. The method as recited in claim 14, further comprising the steps of placing a driver adjacent the first driver cover, attaching a second driver cover to the first end such that the driver is contained between the first driver cover and the second driver cover, and placing the driver in electrical communication with the at least one LED.

16. A luminaire comprising:

a heat sink body that defines a first end, a second end opposite the first end along a central axis;

a first driver cover supported at the first end of the heat sink body, wherein the first driver cover substantially closes the first end;

a driver configured to receive input electrical power from an electrical power source, and output electrical power;

a second driver cover attached to the heat sink body, such that the driver is contained between the first driver cover and the second driver cover;

an LED panel including a substrate supported by the heat sink body at a location such that the first driver cover is disposed between the LED panel and the driver, and at least one LED carried by the substrate, wherein the at least one LED is in electrical communication with the driver so as to receive the output electrical power and, in response, produce illumination; and a lens assembly supported by the heat sink body at the second end, such that at least a portion of the illumination passes through the lens assembly and out the luminaire, wherein each of the second driver cover and the lens assembly is configured to be fit to the heat sink body so as to attach 1) the second driver cover to the first end of the heat sink body, and 2) the lens assembly to the second end of the heat sink body, and wherein the lens assembly comprises a bezel and a lens monolithic with the bezel, and the bezel is attached to the heat sink body.

17. The luminaire as recited in claim 16, wherein the first driver cover is monolithic with the heat sink body.

18. A method for assembling a luminaire, the method comprising the steps of:

placing a driver adjacent a first driver cover that is supported by a heat sink body at a first end of the heat sink body;

fitting a second driver cover to the first end of the heat sink body so as to contain the driver between the first driver cover and the second driver cover;

inserting an LED panel through an open second end of the heat sink body opposite the first end, the LED panel including a substrate and at least one LED supported by the substrate;

supporting the substrate in the heat sink body at a location such that the first driver cover separates the LED panel from the driver;

placing the at least one LED in electrical communication with the driver; and fitting a lens assembly to the second end of the heat sink body, such that illumination produced by the at least one LED passes through and out the luminaire further comprising the step of fabricating a lens assembly including a bezel and a lens supported at its outer periphery by the bezel and monolithic with the bezel, and mounting the lens assembly to the second end of the heat sink body.

19. A lens assembly configured to close an end heat sink of a luminaire, the lens assembly comprising 1) a plastic bezel configured to attach to an open end of the luminaire, wherein the plastic bezel encloses an interior, and 2) a plastic diffuser monolithic with the plastic bezel so as to extend along an entirety of the interior, such that when the lens assembly closes the end of the heat sink, the plastic diffuser is configured to allow illumination from the luminaire to pass through.

* * * * *